US008042836B2

(12) United States Patent
Dudley

(10) Patent No.: US 8,042,836 B2
(45) Date of Patent: Oct. 25, 2011

(54) REVERSIBLY BOUND BOOK

(75) Inventor: Ellen Barrett Dudley, New York, NY (US)

(73) Assignee: Candlepants, Inc., New York, NY (US)

( * ) Notice: Subject to any disclaimer, the term of this patent is extended or adjusted under 35 U.S.C. 154(b) by 535 days.

(21) Appl. No.: 12/335,922

(22) Filed: Dec. 16, 2008

(65) Prior Publication Data

US 2009/0160172 A1 Jun. 25, 2009

Related U.S. Application Data

(60) Provisional application No. 61/008,172, filed on Dec. 19, 2007.

(51) Int. Cl.

| | |
|---|---|
| ***B42D 1/00*** | (2006.01) |
| ***B42D 3/18*** | (2006.01) |
| ***B42D 15/00*** | (2006.01) |
| ***A63H 33/38*** | (2006.01) |
| ***B42F 3/02*** | (2006.01) |

(52) U.S. Cl. ..... 281/21.1; 281/28; 281/51; 281/15.1; 446/147; 446/148; 446/149; 446/151; 446/152; 402/19; 283/63.1

(58) Field of Classification Search ..... 281/21.1, 281/28, 51, 15.1; 446/147, 148, 149, 151, 446/152; 402/19; 283/63.1
See application file for complete search history.

(56) References Cited

U.S. PATENT DOCUMENTS 5,417,508 A * 5/1995 Friedman ..... 402/19

* cited by examiner

*Primary Examiner* — Dana Ross
*Assistant Examiner* — Syed A Islam
(74) *Attorney, Agent, or Firm* — Pryor Cashman LLP; Barry E. Negrin

(57) ABSTRACT

A reversibly bound book is provided. A first cover strip is wrapped around the first edge of a first cover board, passes over the first side of the first cover board and along the first side of the second cover board. One end of a second cover strip is wrapped around the second edge of the second cover board, strip passes along the second side of the second cover board and over the second side of the first cover board. The cover boards are only attached to each other via the cover strips and can be rotated and turned inside-out. One book can have two different appearances simply by rotating the cover boards with respect to each other. At least one floating spine is bound to one cover board, serving as a spine in one configuration and a closure in the other.

12 Claims, 25 Drawing Sheets

REVERSIBLY BOUND BOOK

RELATED APPLICATIONS

Domestic priority is claimed to U.S. Provisional Patent Application No. 61/008,172 filed Dec. 19, 2007 and entitled "Reversible Binding and Cover for Books", the entirety of which is incorporated by reference herein.

BACKGROUND OF THE INVENTION

1. Field of the Invention

The invention relates to book binding methods and techniques, and more specifically to a book binding and method of same that can be turned inside-out and back again to enable a single volume to have more than one preferably non-detachable cover.

2. Description of Related Art

Bookbinding is a centuries-old art that has remained largely unchanged over the last 100 years or so. Advances in paper-making and printing have occurred, but book-binding itself has remained fairly consistent.

Increasingly, many books such as children's books or instruction manuals are being printed in more than one language. A first set of pages may be printed in English, and then a second set may be printed in Spanish, for example. The pages may be bound as a regular book, perhaps the back cover of the English side serving as the front cover of the Spanish side. One set of pages (e.g., one language version) may be upside-down in relation to the other so as to avoid having to read the second set of pages in the opposite direction to that of the first set (e.g., from right to left, if the first set is in English or another left-to-right language).

One of the disadvantages of this conventional model of bilingual works is that the book only effectively has a front cover; the rear cover is being used as the front cover of the second half of the book written in the other language. If the book is an instruction manual and it is left "face down", then the "un-preferred" language front cover will be facing up, possibly confusing the user (who reads the other and hence "preferred" language). If the book is a children's book or a work of fiction, then the ability to utilize the entire cover of the book for artwork, games, or similar purposes is compromised.

Even apart from bilingual books, there is a long-felt need to create new and interesting types of bookbinding in an industry that has remained fairly stagnant from a creativity perspective.

SUMMARY OF THE INVENTION

The invention is a reversible book binding and cover and a book including same. The inventive binding and cover can be manipulated to be completely reconfigurable between a first and second configuration—giving the same book two potentially wholly different covers or appearances—without removal of the cover from the rest of the book. The binding includes a plurality of cover strips, at least one of which passes over a first cover board and then under a second cover board, and at least another of which passes under the first cover board and then over the second cover board. Preferably, there are at least three such strips, and they are more preferably arranged in an alternating pattern. That is, in a preferred embodiment, the first strip is an under-over strip, the second strip is an over-under strip, and the third strip is an under-over strip. The two cover boards are preferably not otherwise attached to each other save via the cover strips. Two separate sets of pages are preferably provided, one set attached to the first cover board, the other set attached to the second cover board. The cover strips thereby form an openable double hinge in between the two cover boards that is capable of being bent fully back on itself and actually split apart as the cover boards rotate relative to each other substantially 720 degrees.

When the book is in a first configuration, the first set of pages is presented as in a conventional book. When the reader is finished with the first set of pages or otherwise desires to go to the second set of pages, the reader separates the two cover boards at the double hinge and rotates the front cover board with respect to the rear cover board. As a result, the strips are flipped inside-out, the second set of pages is now presented as in a conventional book, and the rear cover board is now the front cover board. The book is now in its second configuration.

Preferably, at least a portion of one side of the cover strips is imprinted or otherwise provided with a first image or pattern, etc. (design), and the second opposite side opposite the first is provided with a second image or pattern, etc. (design). In this manner, both the front and rear covers may be utilized fully in both configurations. The content of the first and second set of pages may correspond to the first/second cover image or pattern, respectively.

In a preferred embodiment, at least one floating spine is provided in association with one of the cover boards. More preferably, both cover boards are each provided with a floating spine (for a total of two). The floating spine is preferably fixedly bound to its respective cover board in a fairly conventional manner, so that the hinge between the floating spine and the cover board is not an openable double hinge but a more conventional book-binding hinge. Fastening means may be provided on at least one floating spine for attachment to the opposite cover board, which also may be provided with a mating fastening means. In the first configuration, the first floating spine serves as the spine of the book, while the second floating spine may serve as a closure (e.g., for a diary). When the book is reversed in the second configuration, the second floating spine serves as the spine of the book, and the first floating spine serves as the closure.

In its most general embodiment, the invention is a reversibly bound book, configurable between a first configuration and a second configuration, having first and second cover boards each having a first side and a second side and a first edge and a second edge. A first cover strip has a first end that is wrapped around the first edge of the first cover board and secured to the second side of the first cover board. The second end of the first cover strip is secured to the first side of the second cover board, the first cover strip passing over the first side of the first cover board and along the first side of the second cover board. A second cover strip has a first end that is wrapped around the second edge of the second cover board and secured to the first side of the second cover board. The second end of the second cover strip is secured to the second side of the first cover board. The second cover strip passing along the second side of the second cover board and over the second side of the first cover board. When the book is in the first configuration, the first cover board is part of a front cover of the book and the second cover board is part of a back cover of the book, and when the book is in the second configuration, the second cover board is part of a front cover of the book and the first cover board is part of a back cover of the book.

For purposes of explanation and clarity, the "first side of the first cover board" as defined herein is the front cover of the book in its first configuration, while the "second side of the second cover board" is the rear cover of the book in its first configuration. Similarly, in the second configuration, the second side of the second cover board forms the front cover of the book, and the first side of the first cover board forms the back cover. Thus, the first side of the first cover board always faces out, and the second side of the second cover board also always faces out. Put another way, that which is defined as the first side of the first cover board and the first side of the second cover board will face the same direction when the book is closed, regardless of which configuration the book is in (in the first configuration, both first sides will face up assuming the front cover is facing up, and in the second configuration, both side will face down assuming the front cover is facing up). It does not matter which of the two cover boards of a book is the "first" and which is the "second".

BRIEF DESCRIPTION OF THE DRAWINGS

FIGS. 6-1 through 6-20 are various front elevational and perspective views of a reversible book in accordance with the invention in operation, that is, being flipped from a first configuration to a second configuration and back again.

DETAILED DESCRIPTION OF THE INVENTION AND DRAWINGS

Description of the invention will now be given with reference to FIGS. 1-8. It should be understood that these figures are exemplary in nature and in no way serve to limit the scope of the invention, which is defined by the claims appearing hereinbelow.

Figure 1:
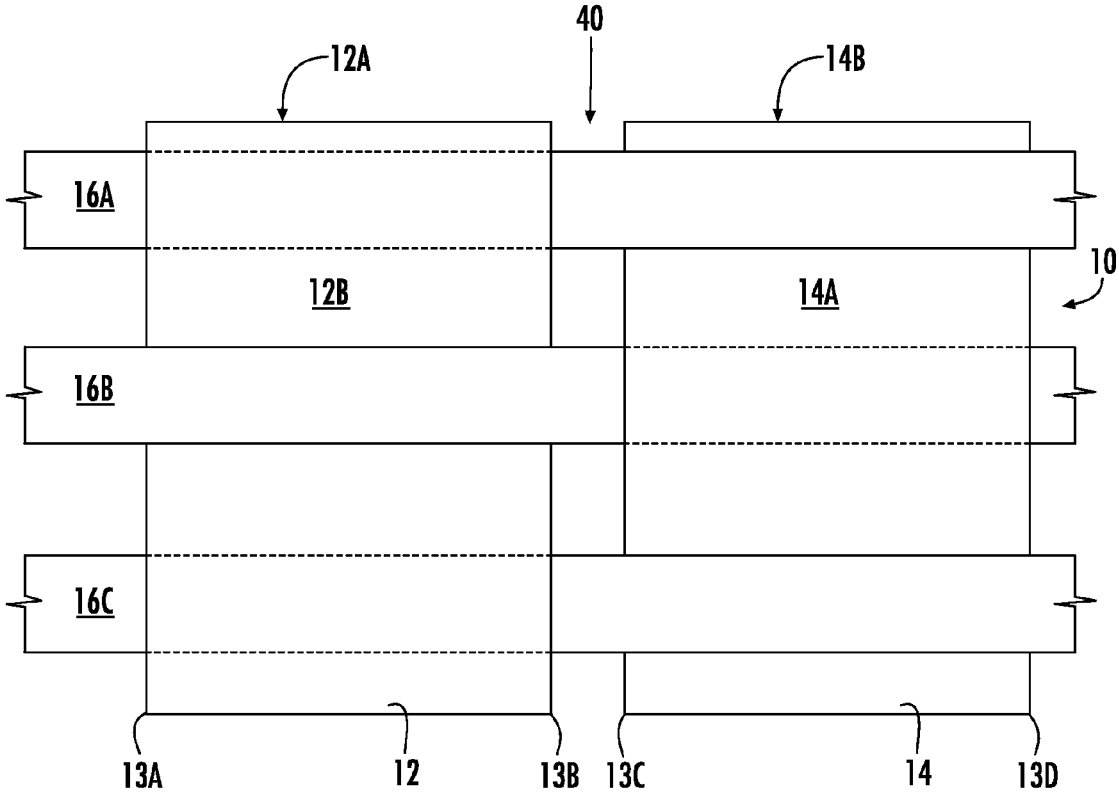
FIG. 1 is a front elevational schematic of a reversible book in accordance with the invention open to the first center spread but without pages for clarity.

A basic embodiment of the invention is shown open in FIG. 1 as reversible book 10. Book 10 includes a first cover board 12, having a first side 12A and a second side 12B (shown in FIG. 1), and a second cover board 14, having a first side 14A (shown in FIG. 1) and a second side 14B, as do many conventional books. However, cover boards 12 and 14 are held together via at least two cover strips 16. In the preferred embodiment, three cover strips 16 are provided: cover strip 16A passes under cover board 12 and over cover board 14; cover strip 16B passes over cover board 12 and under cover board 14; and cover strip 16C passes under cover board 12 and over cover board 14. The ends of cover strips 16A-C wrap around and are glued down near (but preferably not directly at) respective edges 13A-D of cover boards 12 and 14 (see FIG. 4).

Figure 4:
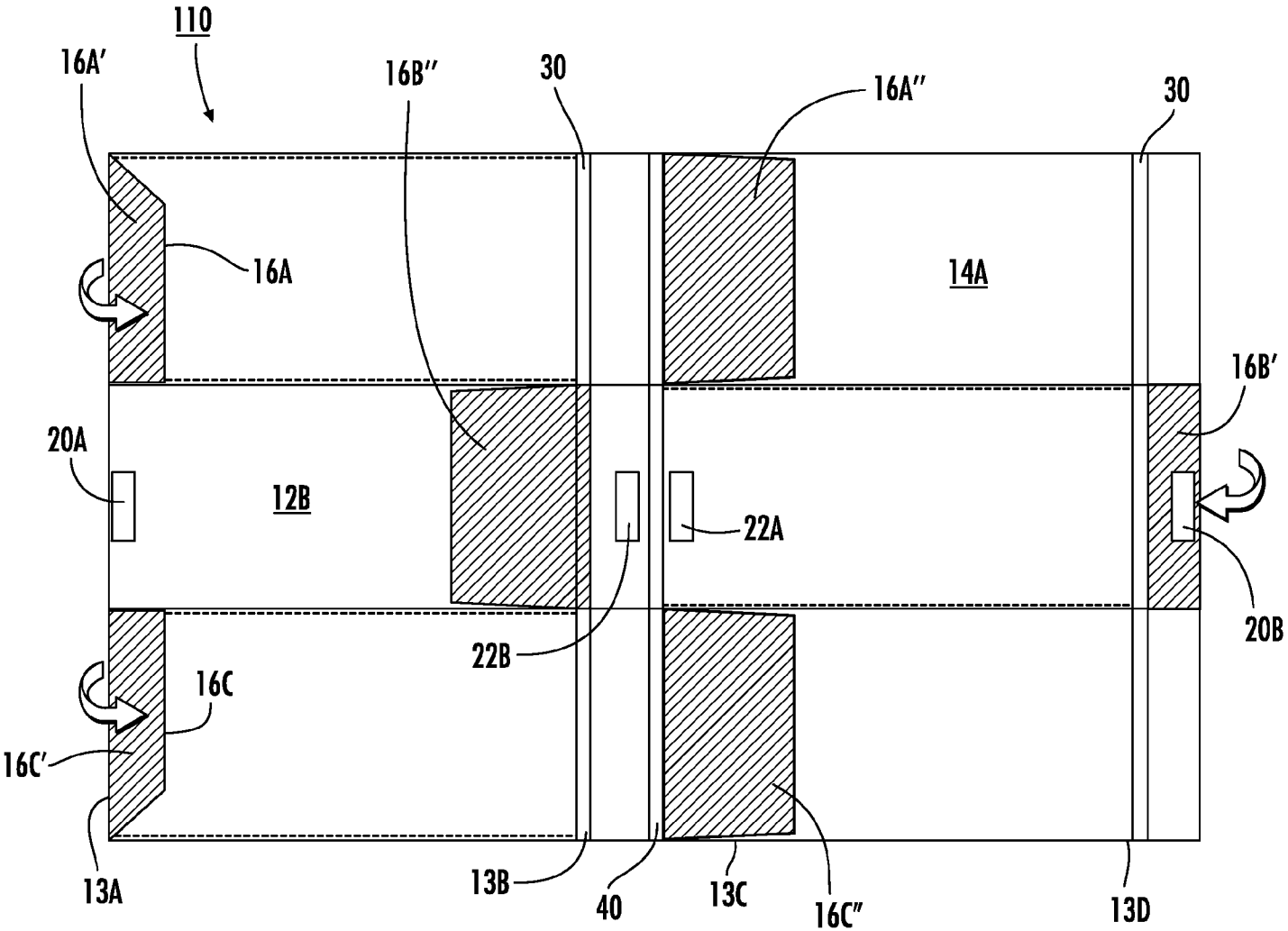
FIG. 4 is a front elevational schematic of the assembled reversible book of FIG. 3 open to the first center spread with the cover strips attached thereto but without pages for clarity.

Specifically, in the preferred embodiment shown open to a center spread in FIG. 4, first end 16A' of cover strip 16A is glued to side 12B of cover board 12 near edge 13A and wraps around edge 13A. The bulk of cover strip 16A passes over (but is not glued to) side 12A of cover board 12. The other end 16A" of cover strip 16A is glued to side 14A near edge 13C. Similarly, first end 16B' of cover strip 16B is glued to side 14A of cover board 14 and wraps around edge 13D. The bulk of cover strip 16B passes over (but is not glued to) side 14B of cover board 14. The other end 16B" of cover strip 16B is glued to side 12B near edge 13B. Finally, first end 16C' of cover strip 16C is glued to side 12B of cover board 12 near edge 13A and wraps around edge 13A. The bulk of cover strip 16C passes over (but is not glued to) side 12A of cover board 12. The other end 16C" of cover strip 16C is glued to side 14A near edge 13C.

Cover boards 12 and 14 are not attached to each other in any way other than by the cover strips 16A-C. The strips 16A-C thus form a double hinge 40 in between cover boards 12 and 14 (the space between the cover boards is greatly exaggerated for clarity). Not only does the double hinge 40 allow for the complete bending or folding of the cover boards 360 degrees around so that the front cover can contact the rear cover, but the cover boards may be completely flipped or rotated with respect to one another, a total of 720 degrees. By doing so, the side of the cover strips 16 that was facing the reader is now facing the cover boards 12 and 14, and vice versa.

Figure 2:
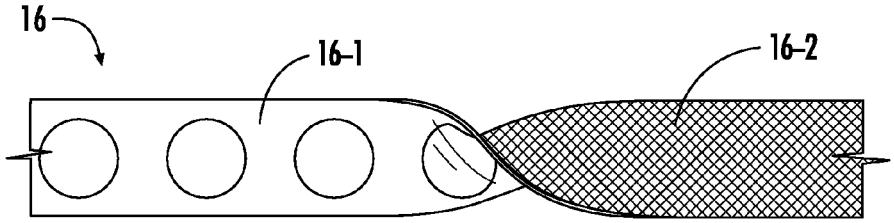
FIG. 2 is an enlarged front elevational schematic of a portion of a cover strip in accordance with the invention.

FIG. 2 depicts an exemplary cover strip 16 having a first side 16-1 and a second side 16-2. First side 16-1 is provided with one image, texture, color, pattern, text, or combination thereof, and second side 16-2 is provided with another image, texture, color, pattern, text, or combination thereof. When the book is in its first configuration, one side (either 16-1 or -2) is presented to the reader, and when the book is in its second configuration, the other side is presented to the reader. This makes the book perfect for bilingual tomes such as instruction manuals or children's books.

Figures 1, 6:
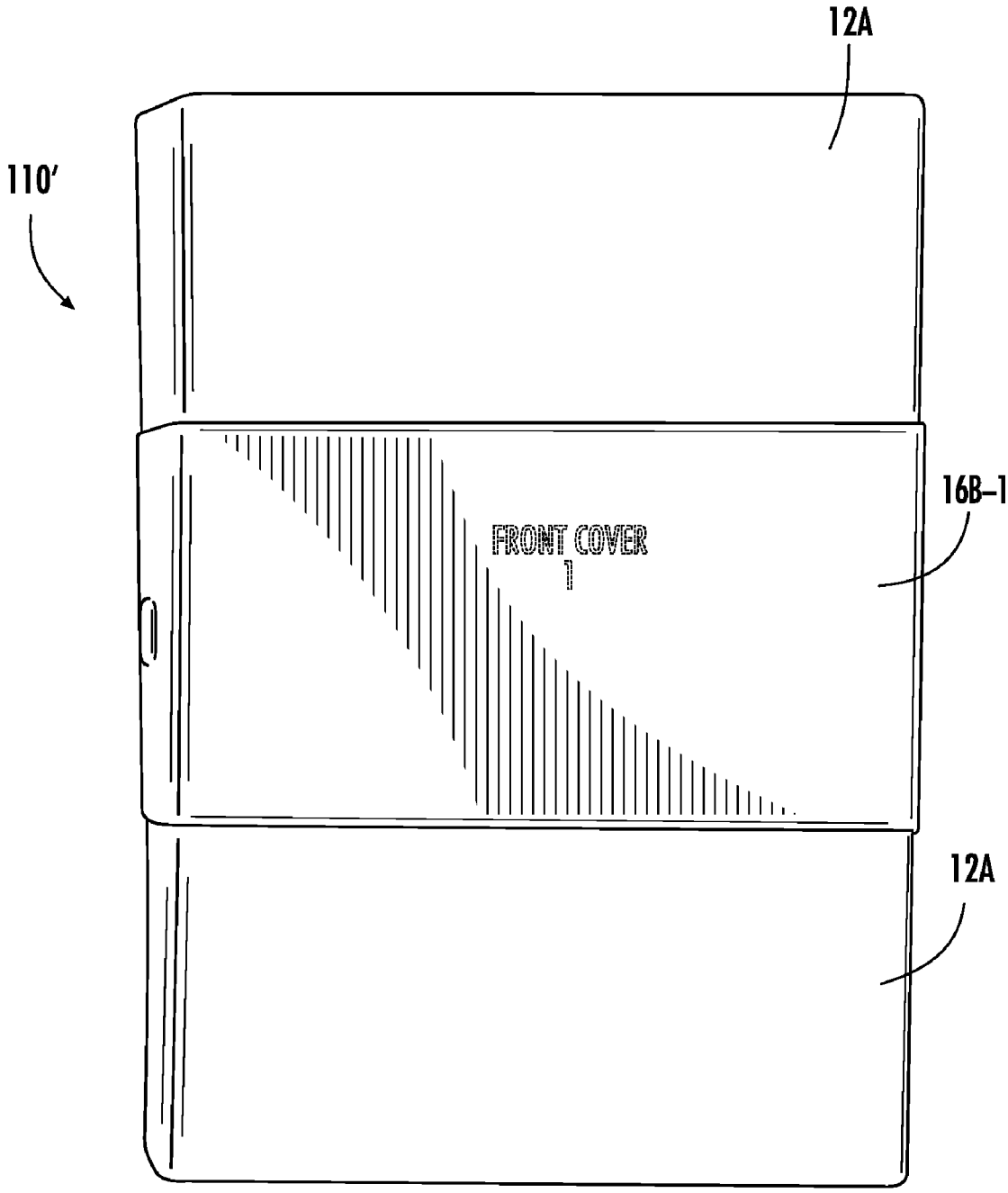
Figures 2, 6:
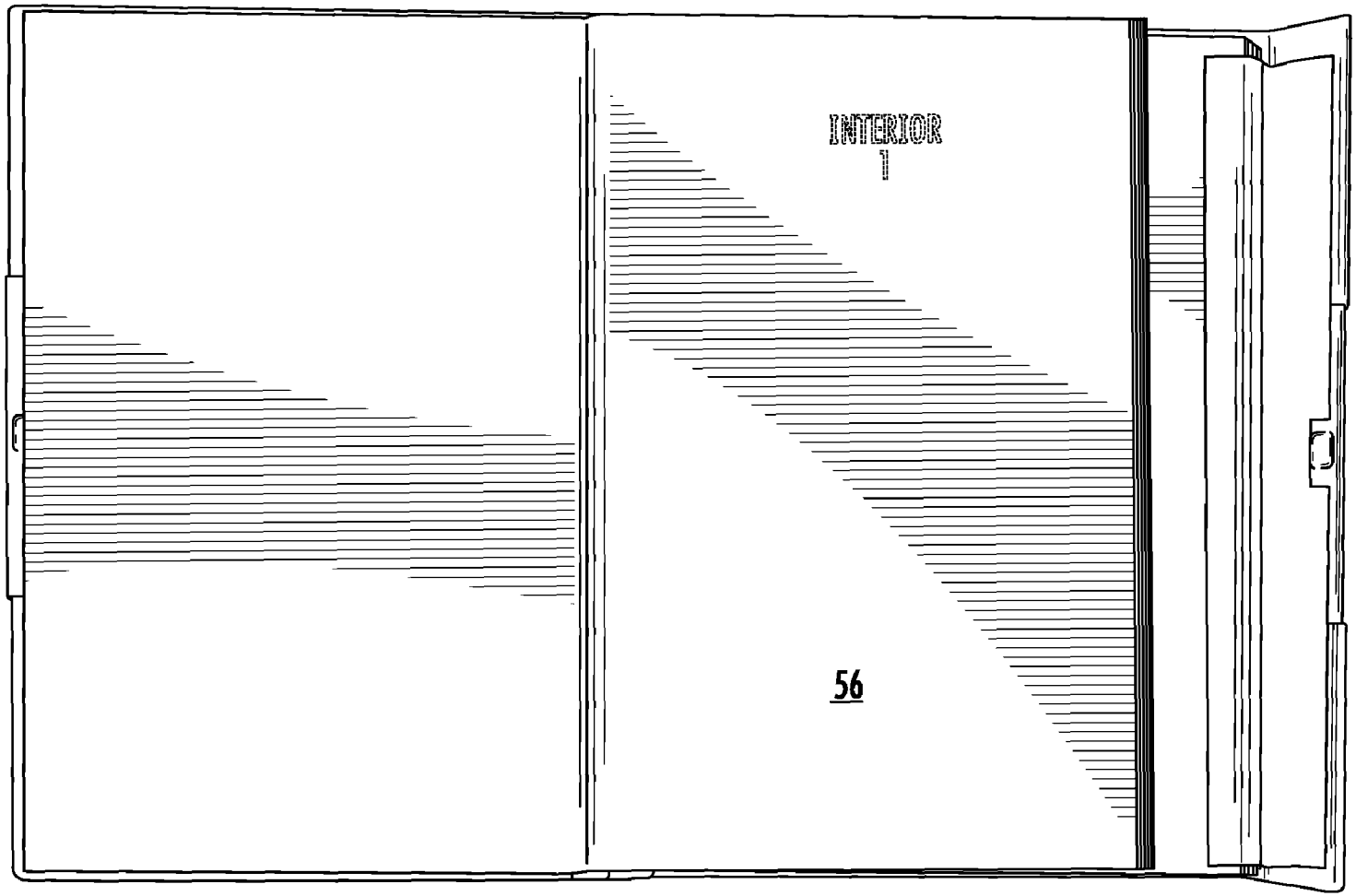
Figures 3, 6:
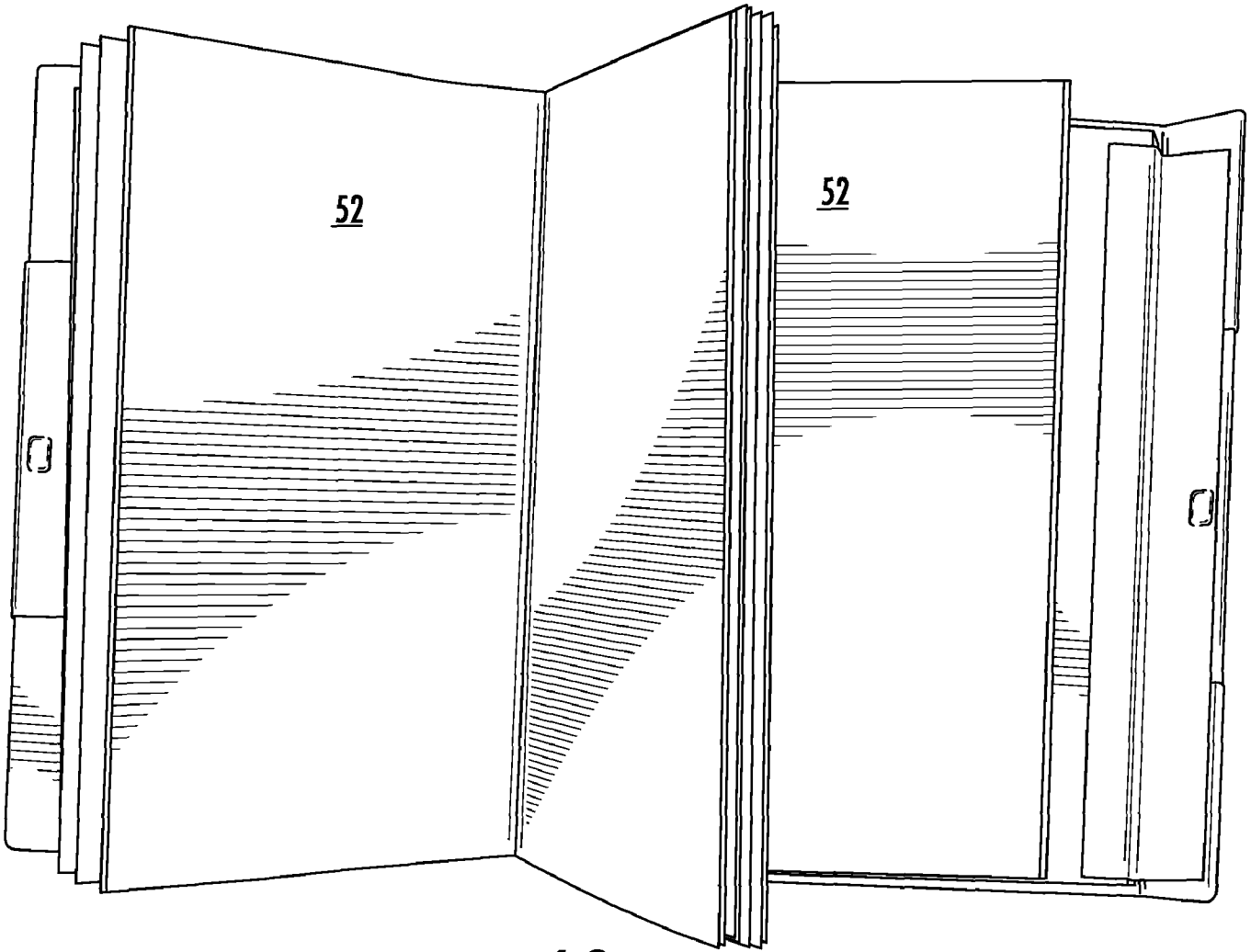
Figures 4, 6:
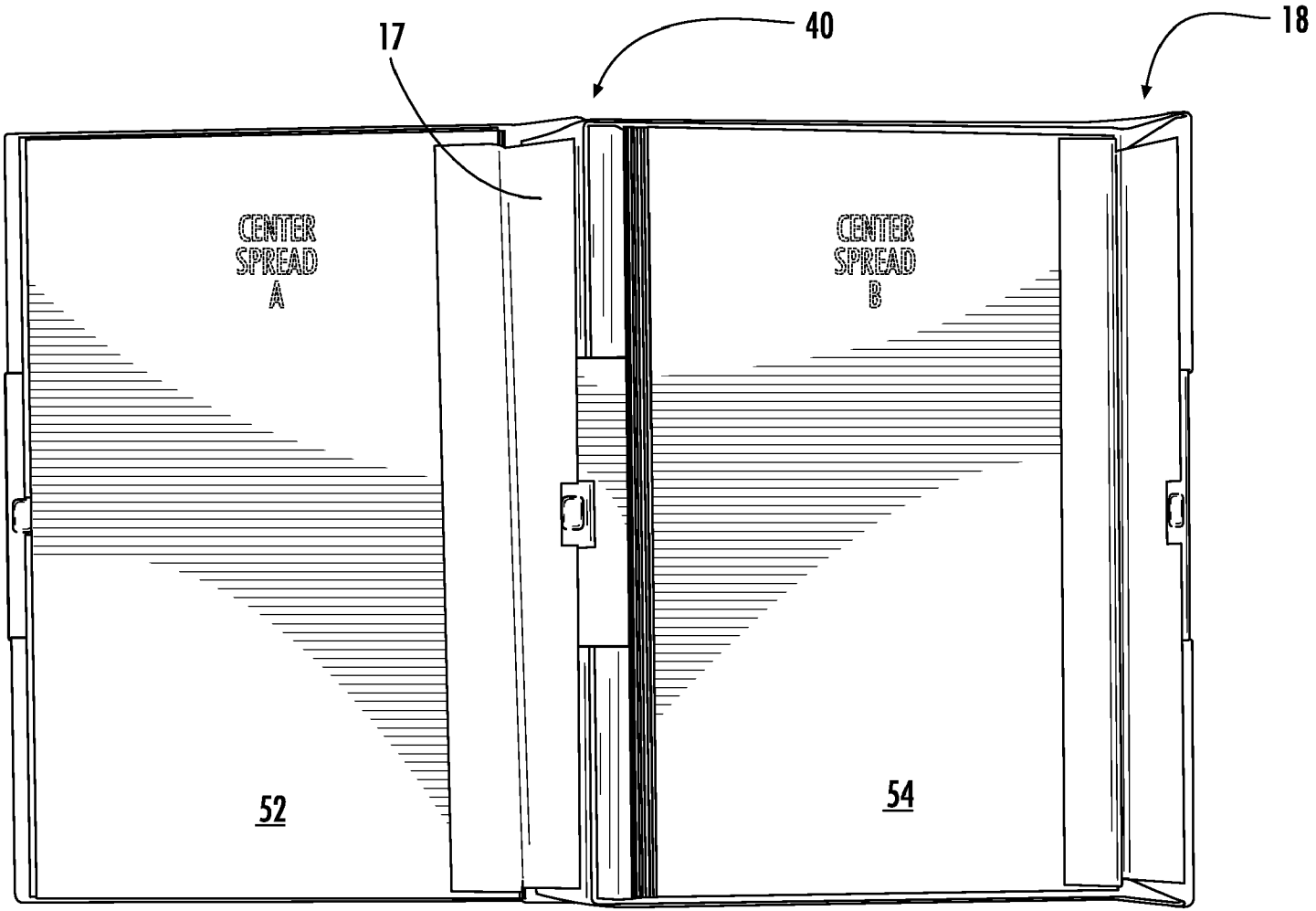
Figures 5, 6:
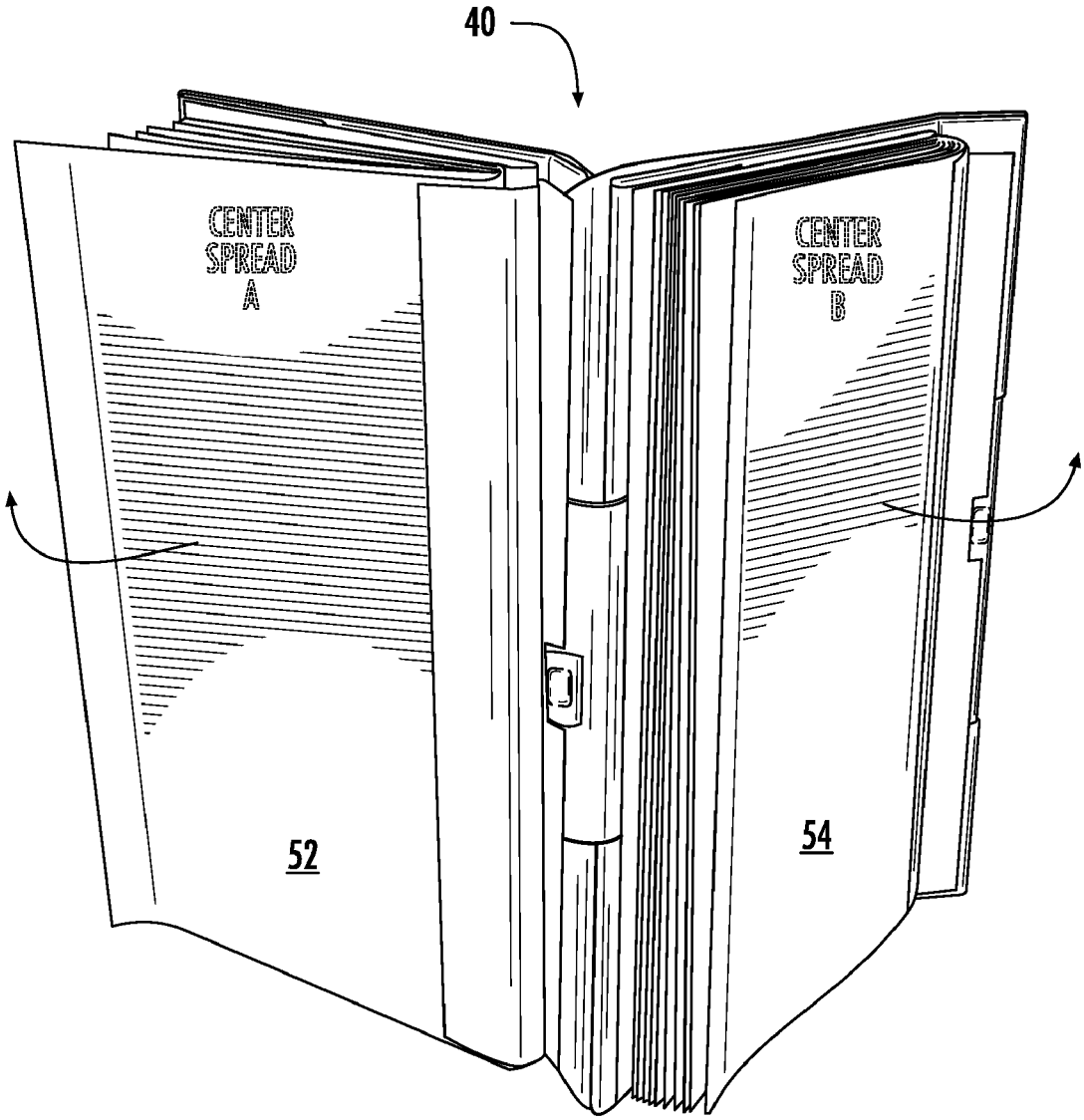
Figure 6:
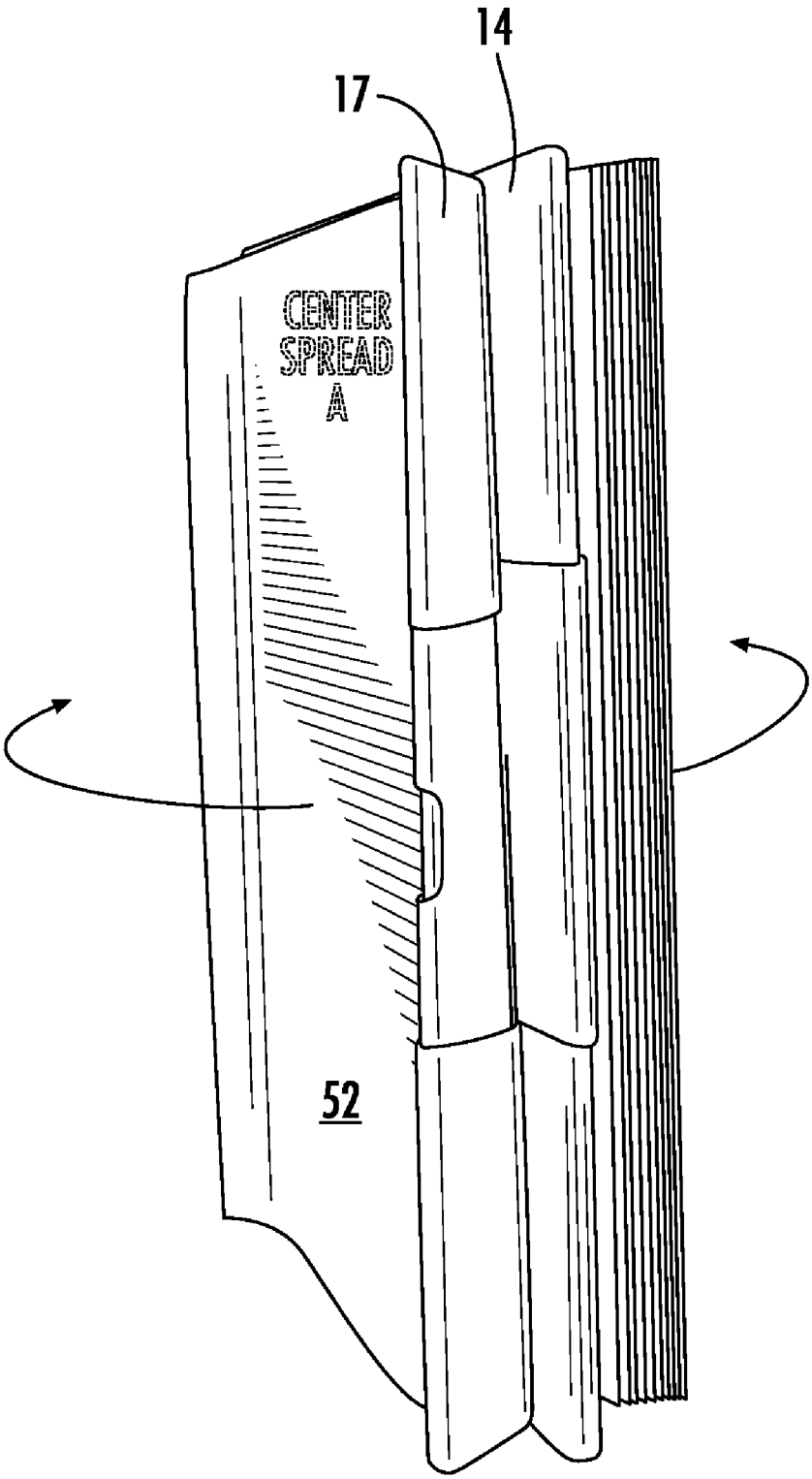
Figures 6, 7:
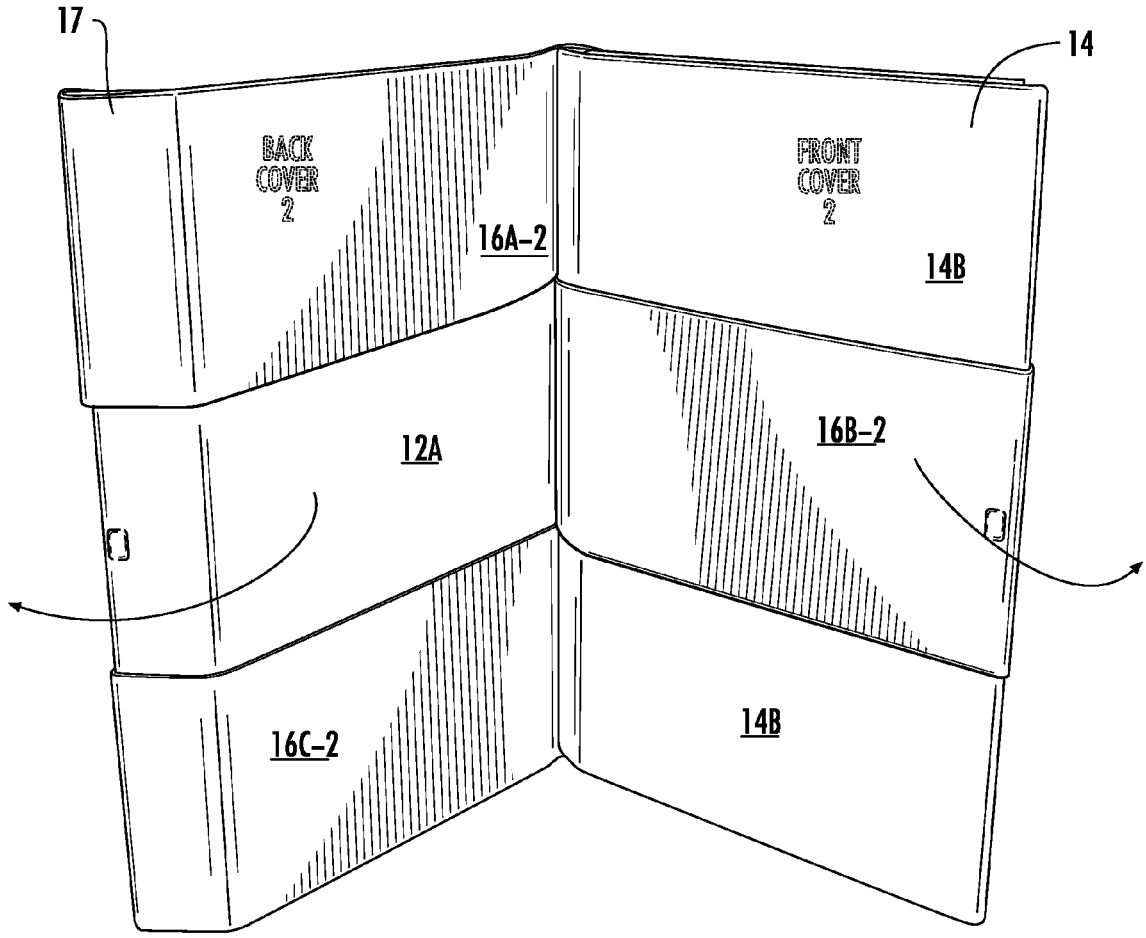
Figures 6, 7, 8:
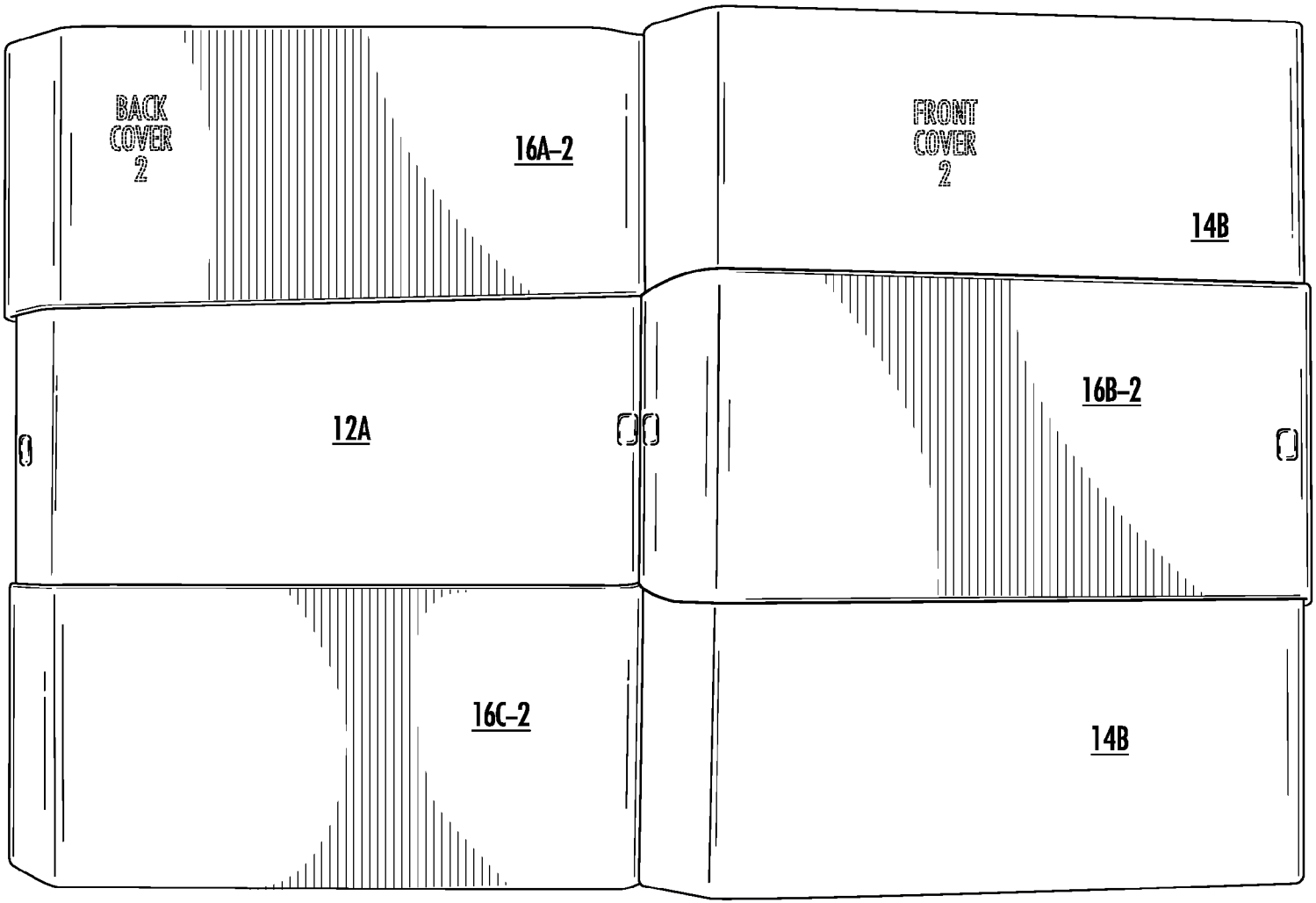
Figures 6, 7, 8, 9:
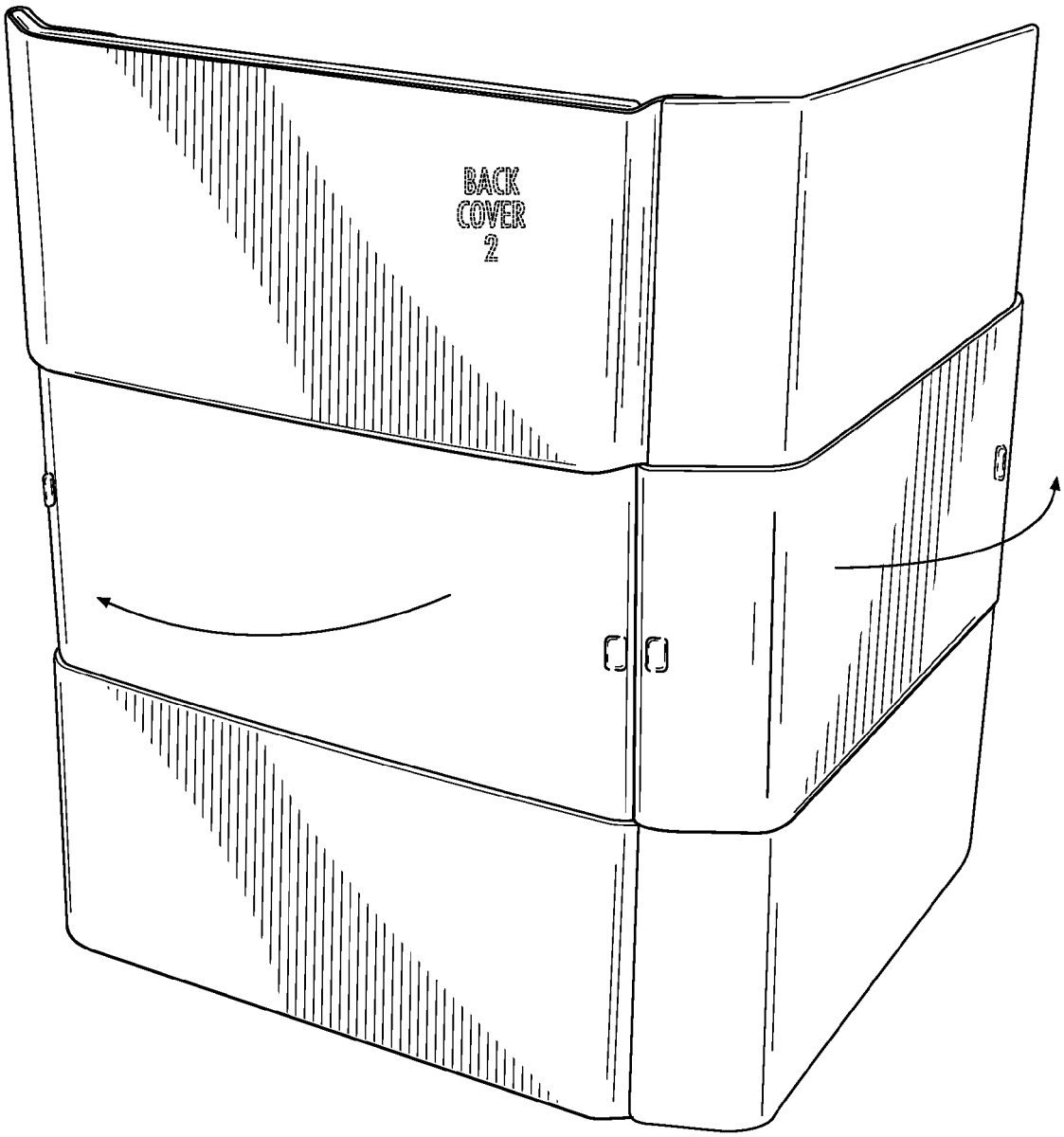
Figures 6, 7, 8, 9, 10:
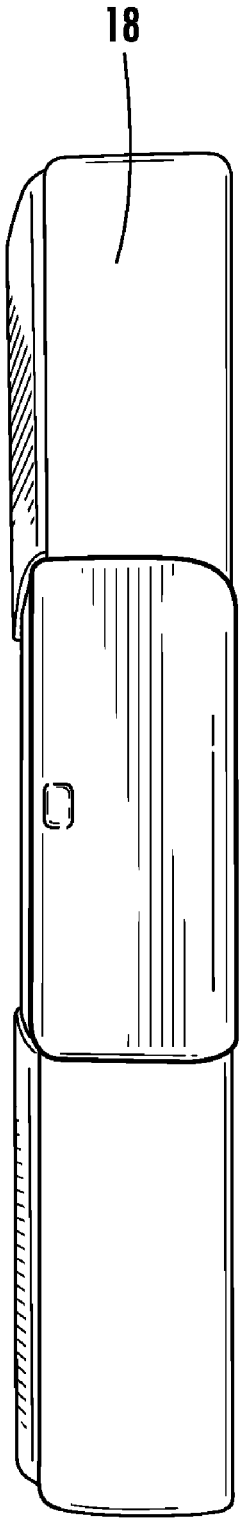
Figures 6, 7, 8, 9, 10, 11:
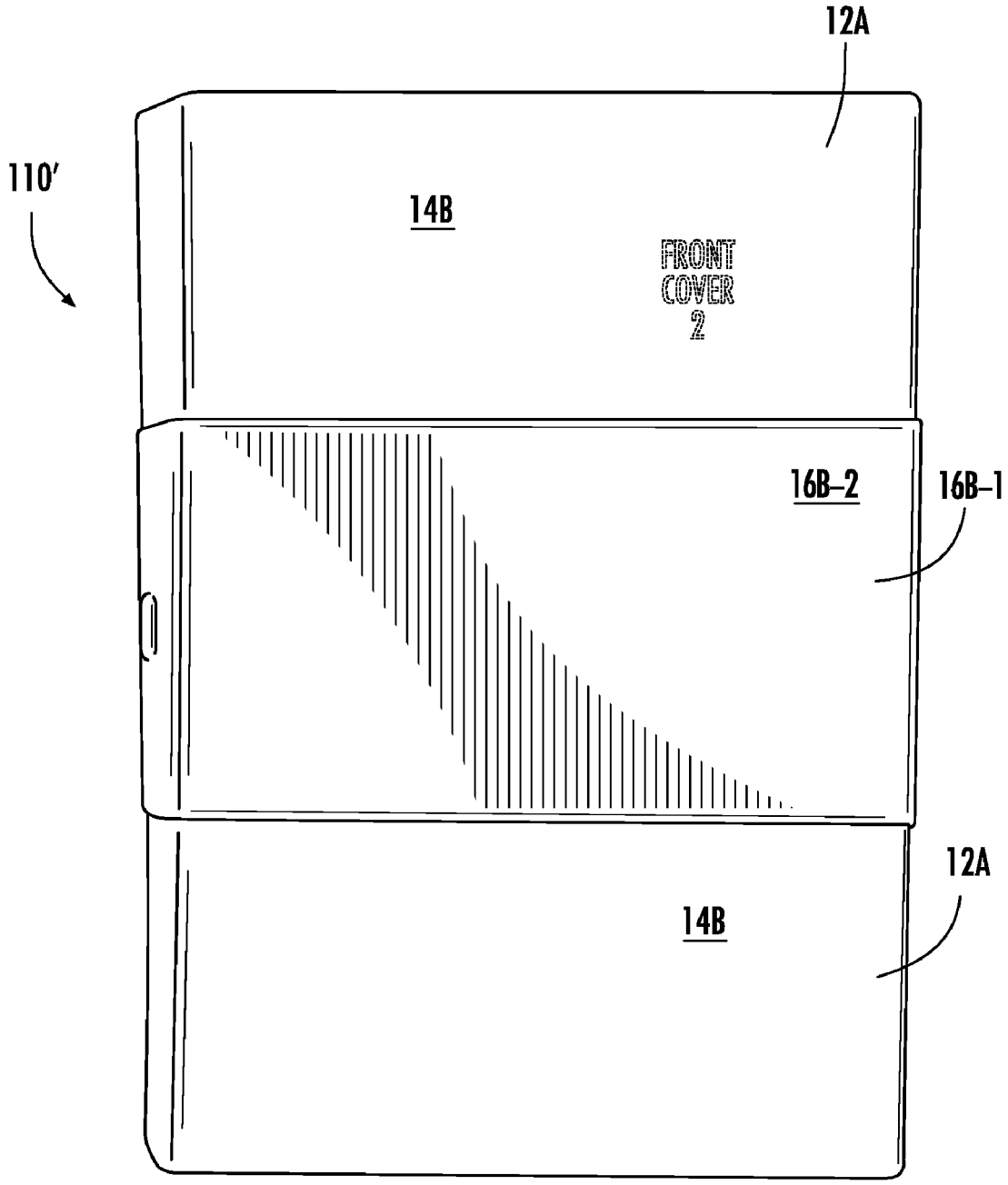
Figures 6, 7, 8, 9, 10, 11, 12:
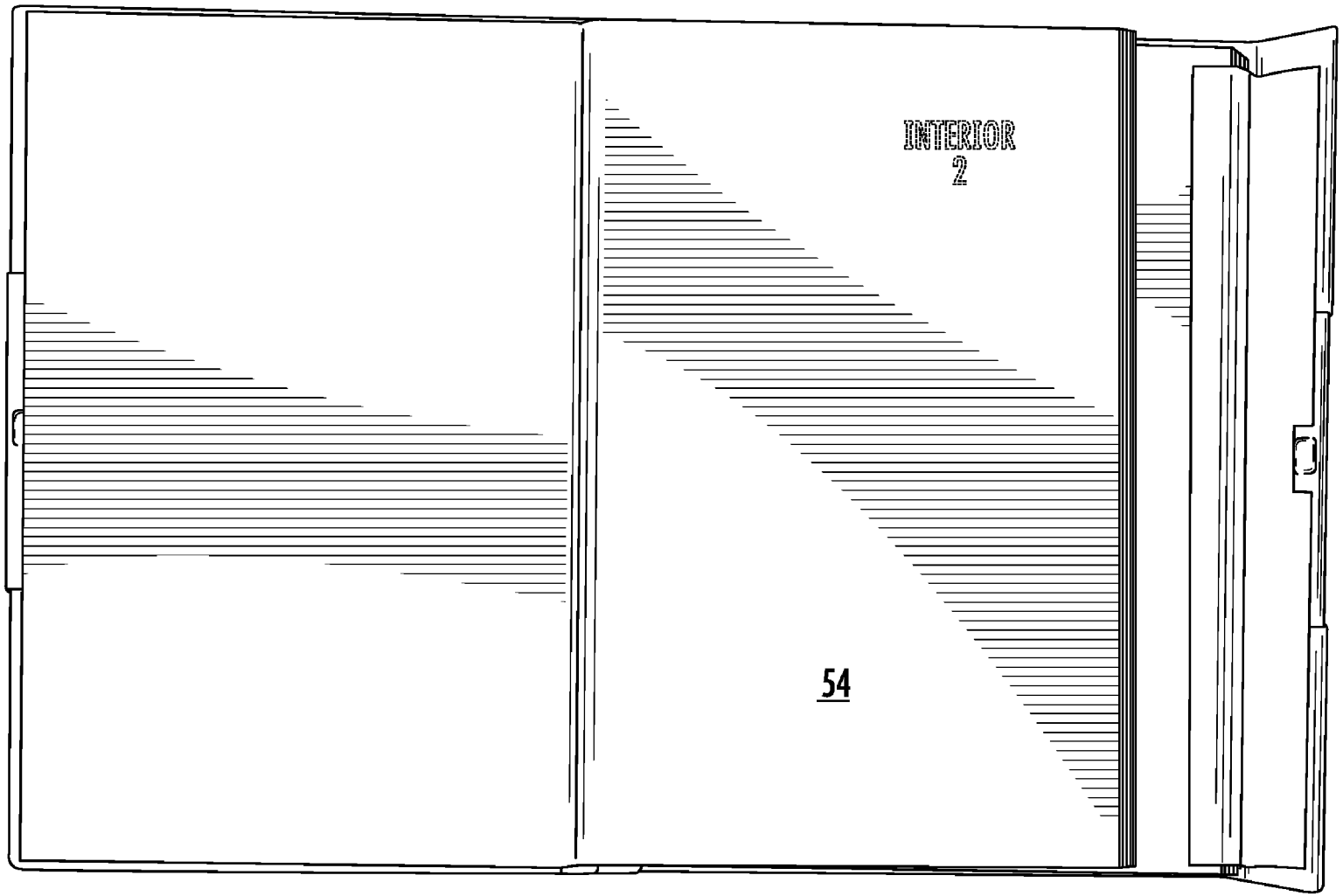
Figures 6, 7, 8, 9, 10, 11, 12, 13:
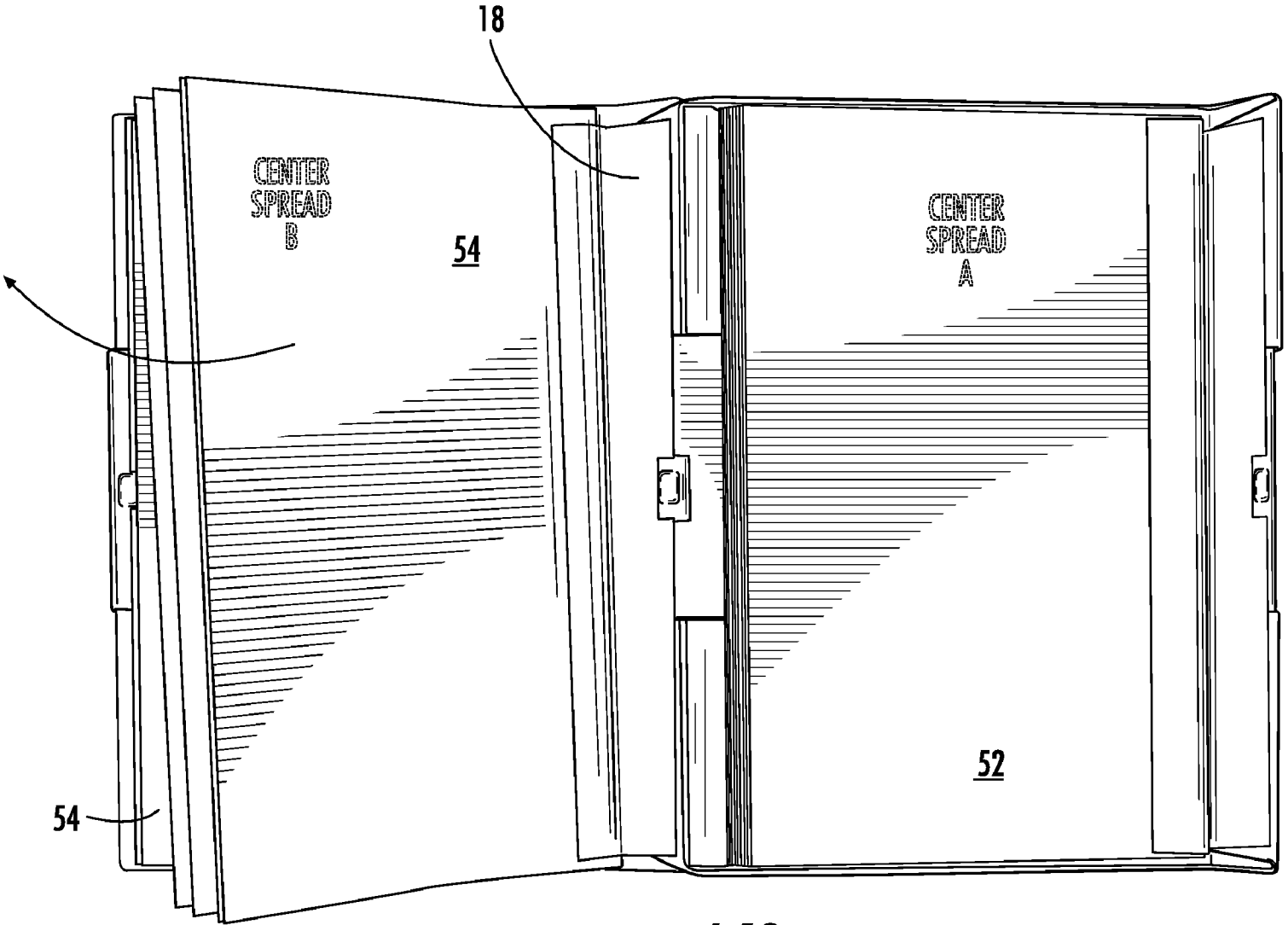
Figures 6, 7, 8, 9, 10, 11, 12, 13, 14:
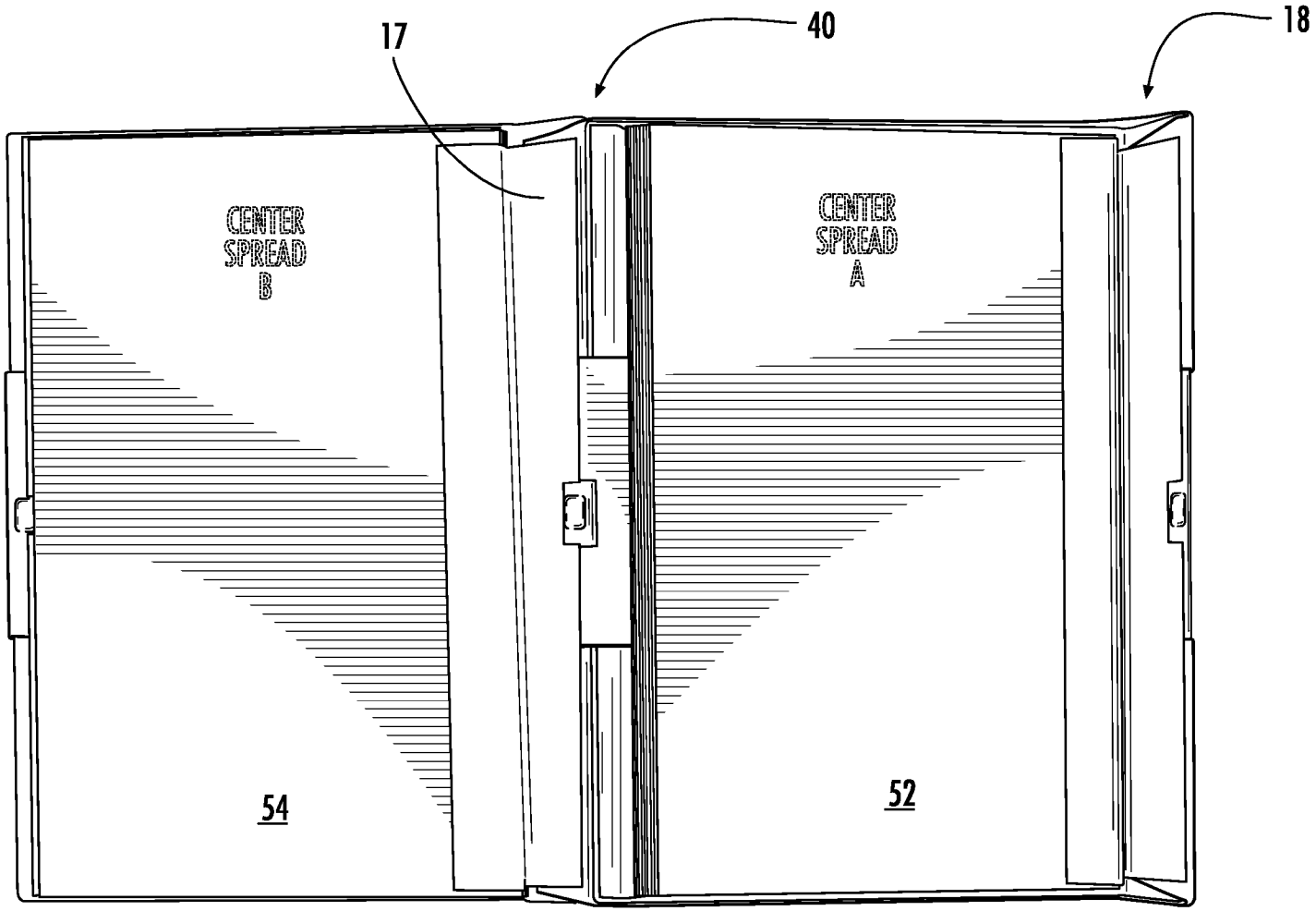
Figures 6, 7, 8, 9, 10, 11, 12, 13, 14, 15:
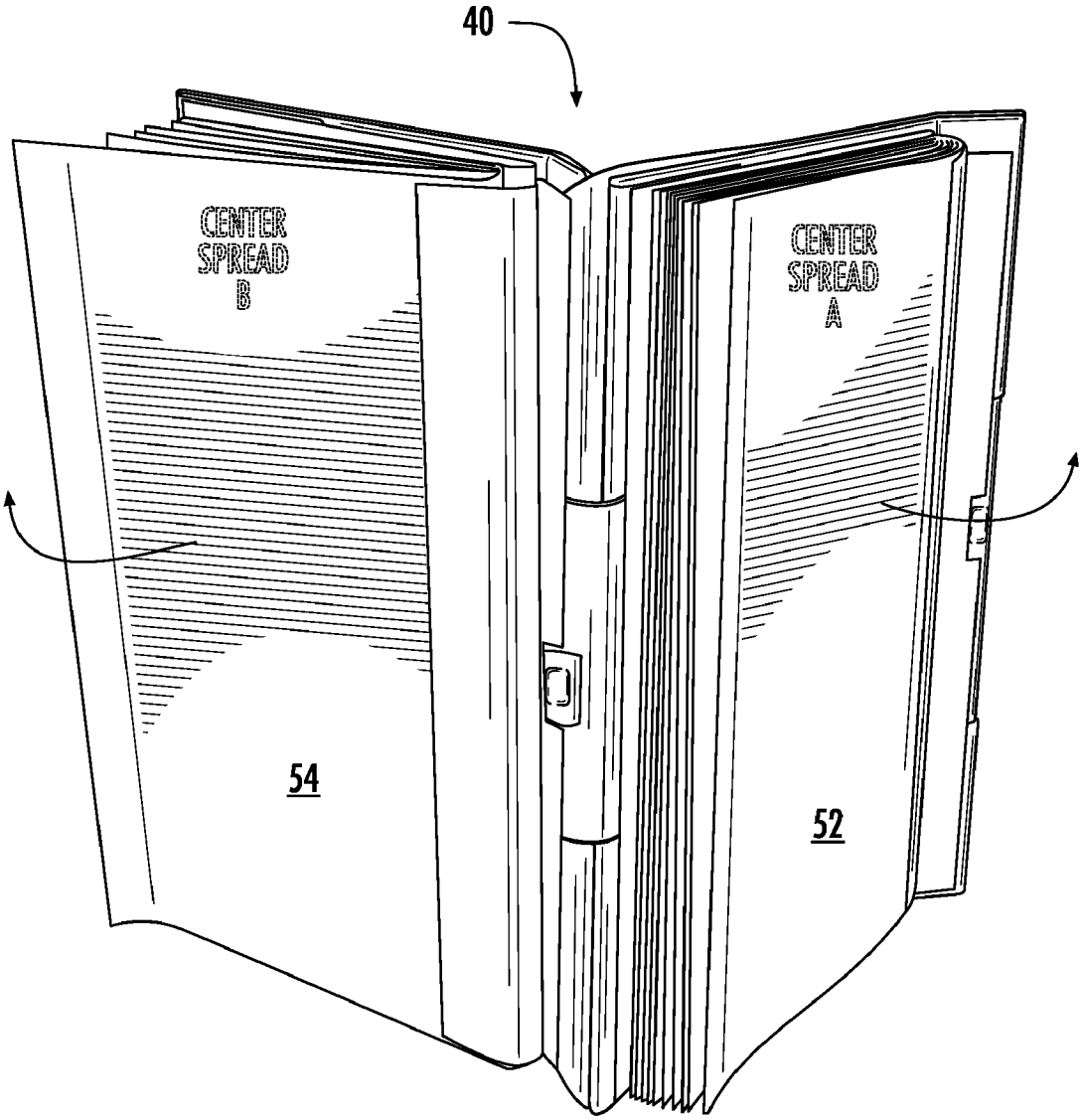
Figures 6, 7, 8, 9, 10, 11, 12, 13, 14, 15, 16:
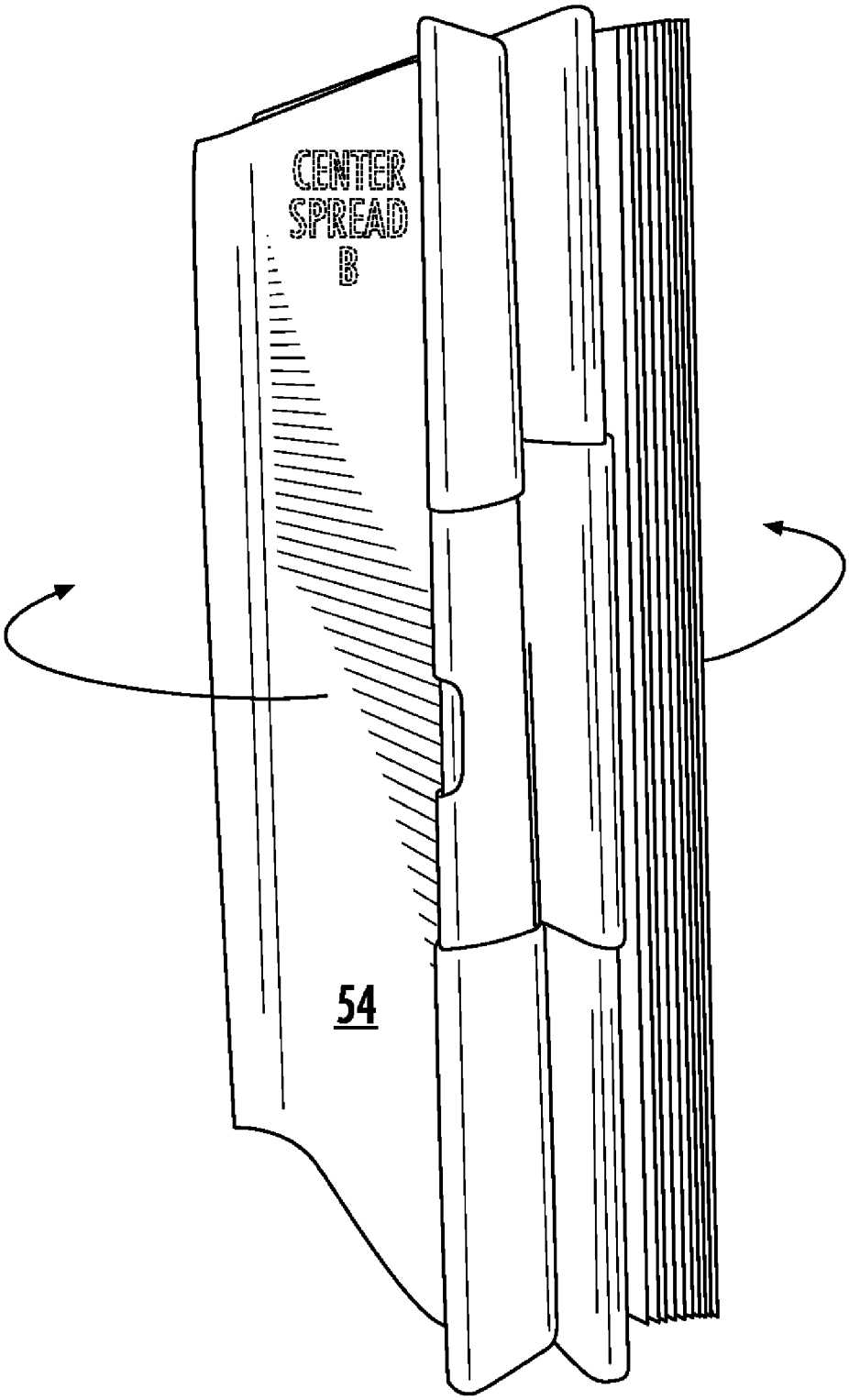
Figures 6, 7, 8, 9, 10, 11, 12, 13, 14, 15, 16, 17:
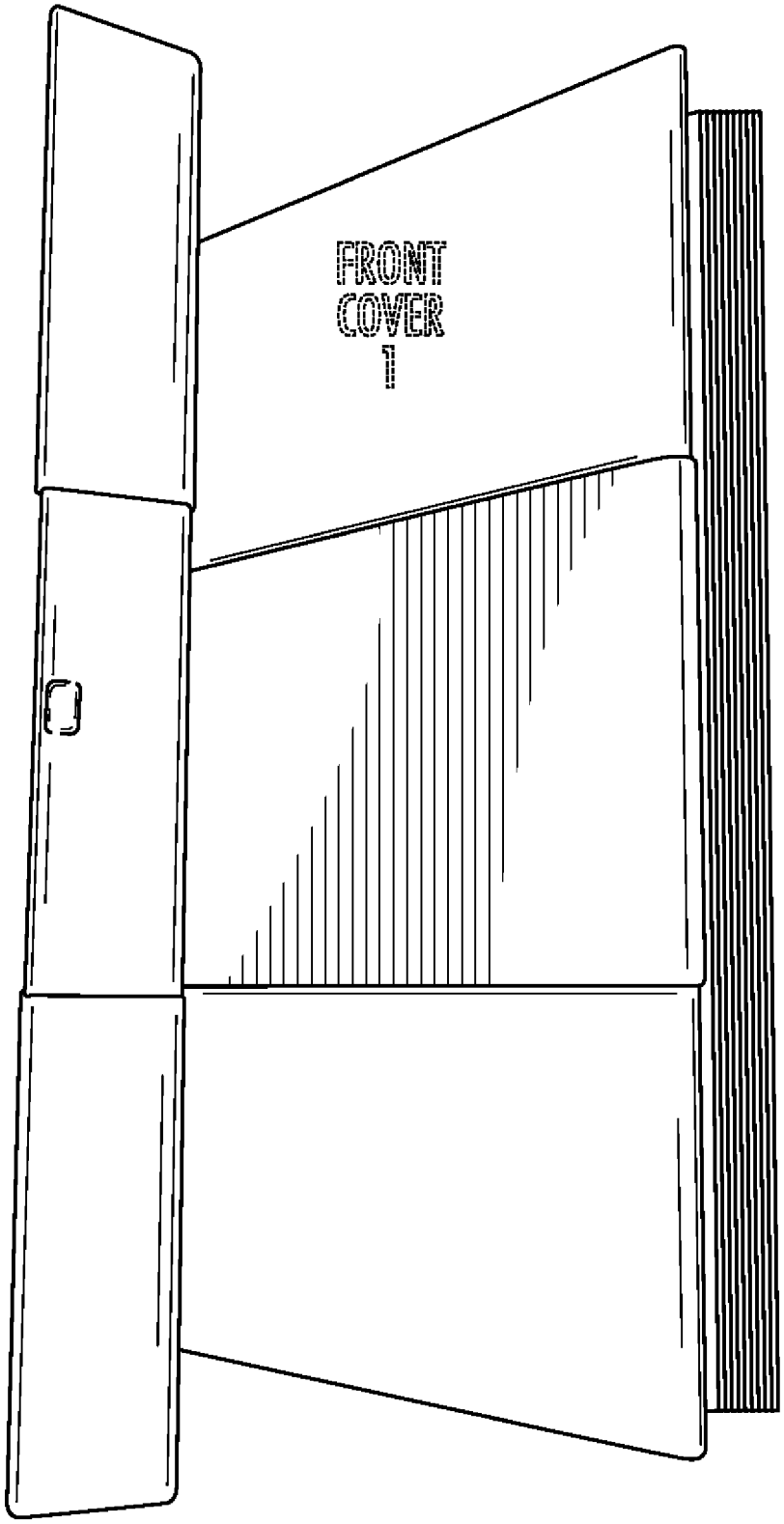
Figures 6, 7, 8, 9, 10, 11, 12, 13, 14, 15, 16, 17, 18:
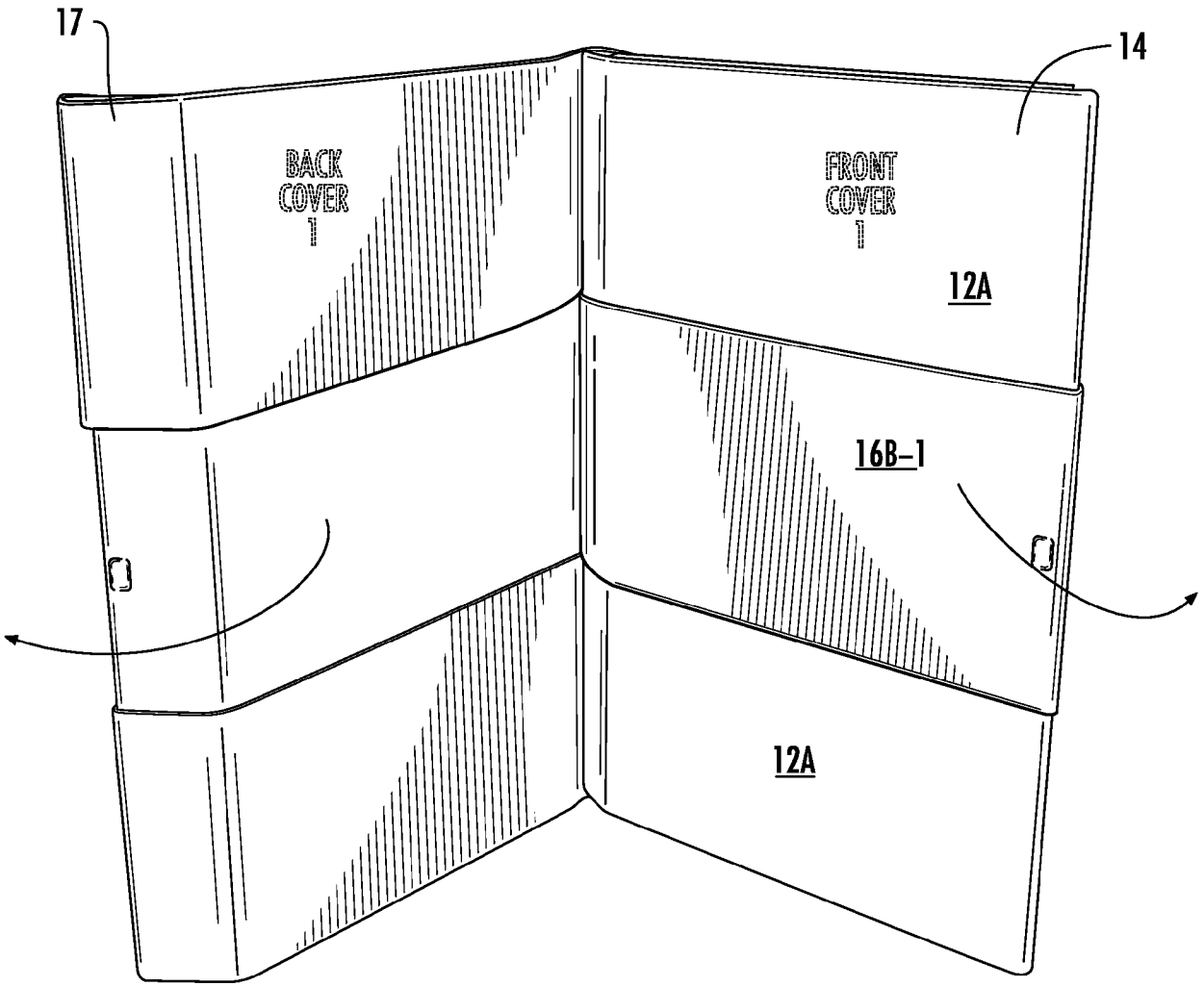
Figures 6, 7, 8, 9, 10, 11, 12, 13, 14, 15, 16, 17, 18, 19:
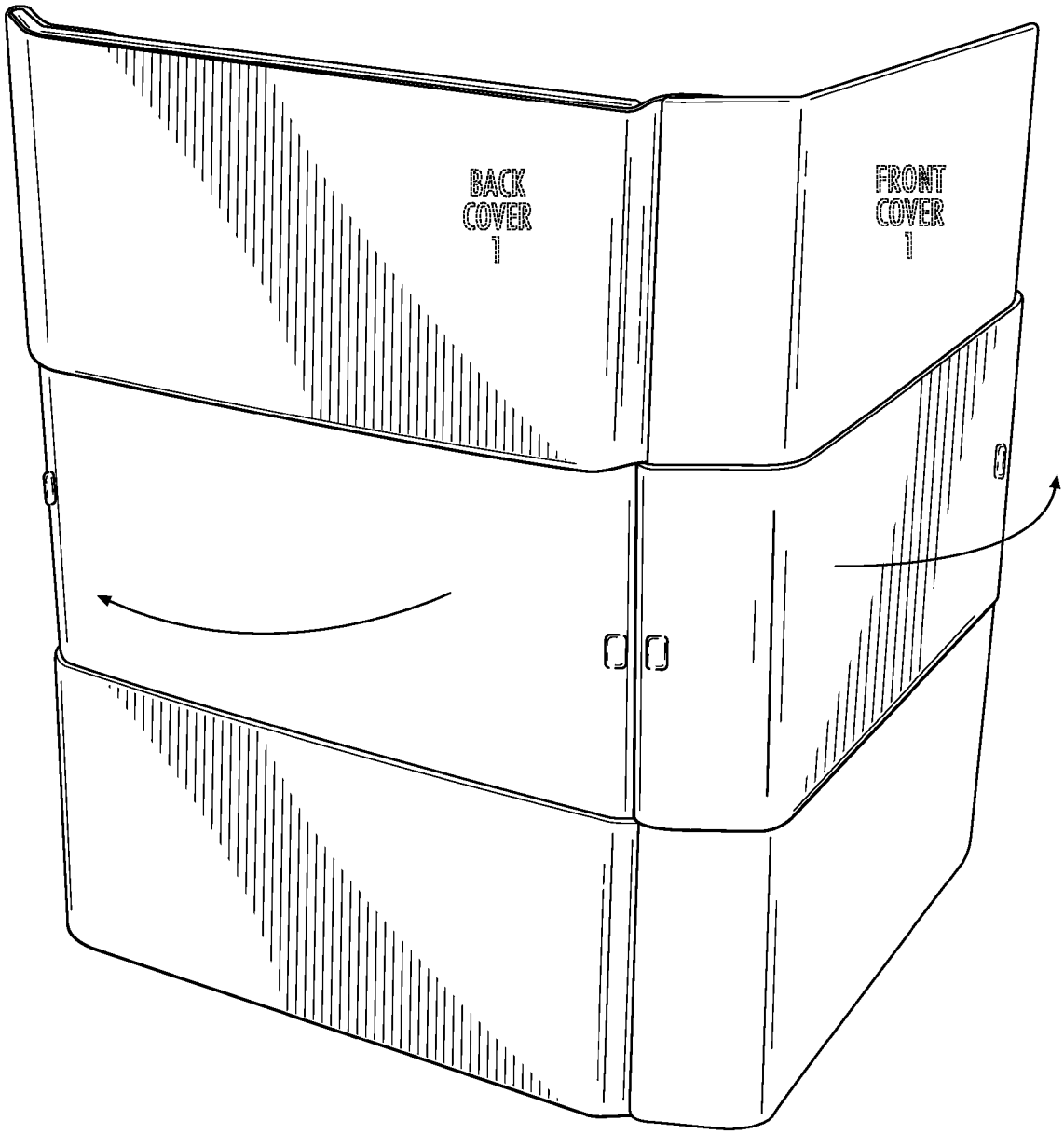
Figures 6, 7, 8, 9, 10, 11, 12, 13, 14, 15, 16, 17, 18, 19, 20:
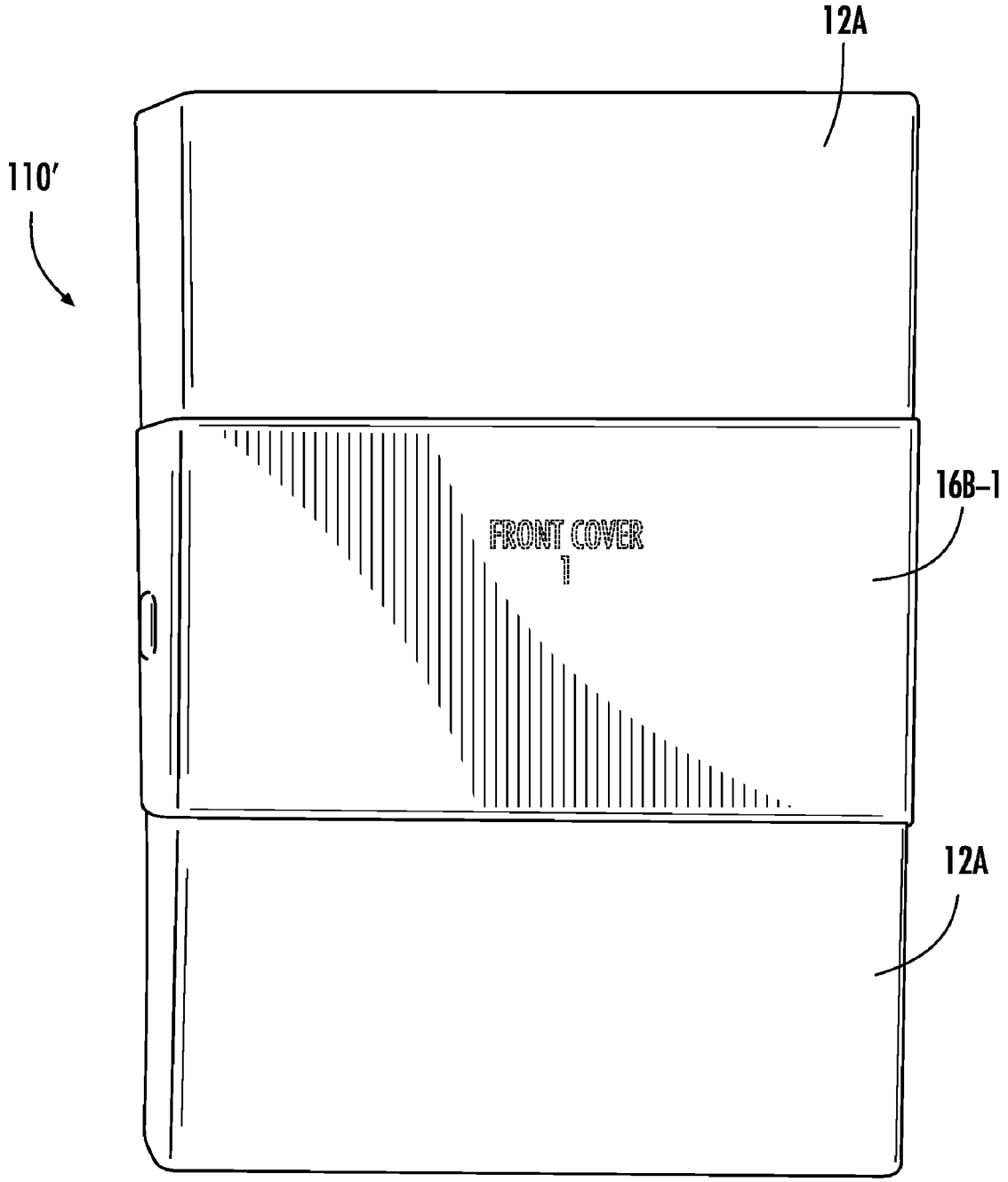
Figure 7A:
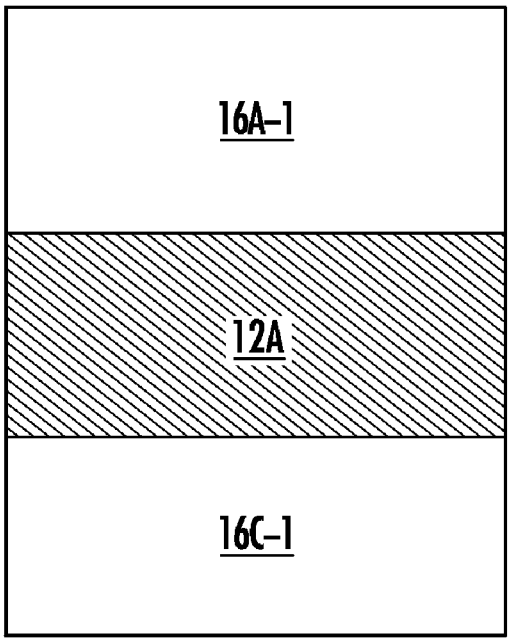
FIG. 7A is a front elevational schematic of a closed reversibly bound book in its first configuration in accordance with the invention.
Figure 7B:
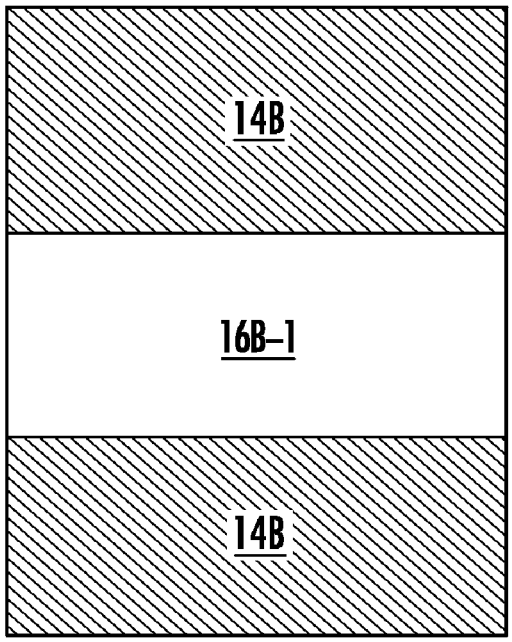
FIG. 7B is a rear elevational schematic of a closed reversibly bound book in its first configuration in accordance with the invention.

This is shown schematically but in more detail in FIGS. 7 and 8. FIGS. 7A-B show the front and rear covers of book 10 (or 110). In FIG. 7A, cover strips 16A and C have sides 16A-1 and 16C-1 visible to the reader. Side 12A of cover board 12 is visible in the central portion of the front of the book. Preferably, sides 16A-1 and 16C-1 and the central section of side 12A visible in FIG. 7A form a cohesive design, image, or pattern. The rear cover of book 10, 110 is shown in FIG. 7B. Here, side 16B-1 of cover strip 16B is visible to the reader, as are top and bottom sections of side 14B of cover board 14. Preferably, side 16B-1 and the top and bottom sections of side 14B form a cohesive design, image, or pattern on the rear of the book. More preferably, the rear of the book in configuration 1 (i.e., 16B-1 plus the top and bottom sections of side 14B) form a unified cohesive design with the front of the book (i.e., sides 16A-1 and 16C-1, and the central section of side 12A).

Figure 8A:
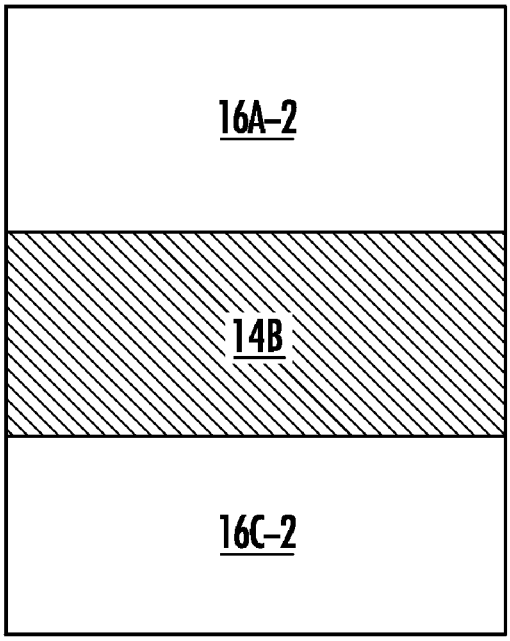
FIG. 8A is a front elevational schematic of a closed reversibly bound book in its second configuration in accordance with the invention.
Figure 8B:
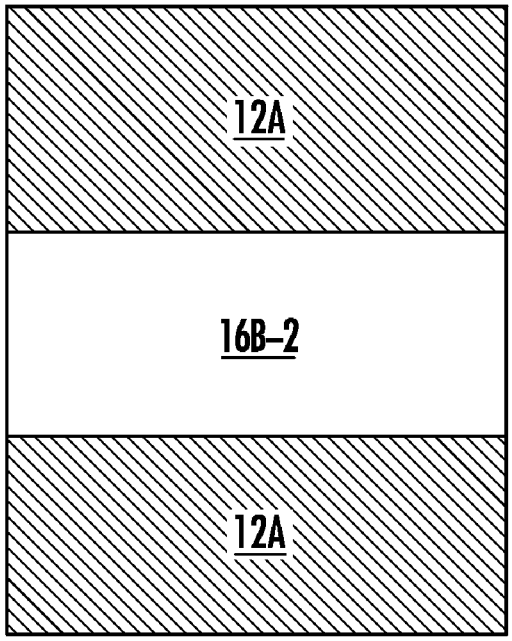
FIG. 8B is a rear elevational schematic of a closed reversibly bound book in its second configuration in accordance with the invention.

The book is shown in its second configuration in FIGS. 8A and 8B; FIG. 8A depicts the front of the book and FIG. 8B depicts the rear of the book. Sides 16A-2 and 16C-2 visible to the reader. Side 14B of cover board 14 is visible in the central portion of the front of the book. In FIG. 8B, side 16B-2 of cover strip 16B is visible to the reader, as are top and bottom sections of side 12A of cover board 12. As with the first configuration of the book, it is preferred that the cover strips and respective exposed sections of the cover boards form a cohesive image or design, and it is more preferred that a unified design appears on the front (FIG. 8A) and rear (FIG. 8B) of the book.

When the book is in one configuration, a first language might appear on the cover, and when it is flipped to its other configuration, another language might appear on the book. If a single set of pages (not shown in FIG. 1) is bound into this type of book, then the reader will be presented with the last page of the set (assuming she does not turn the book over). The embodiment with a single set of pages is especially well adapted for bilingual use where one language is read left-to-right (e.g., English, Spanish, French, etc.) and the other is read right-to-left (e.g., Hebrew, Arabic, Persian, etc.).

Figure 3:
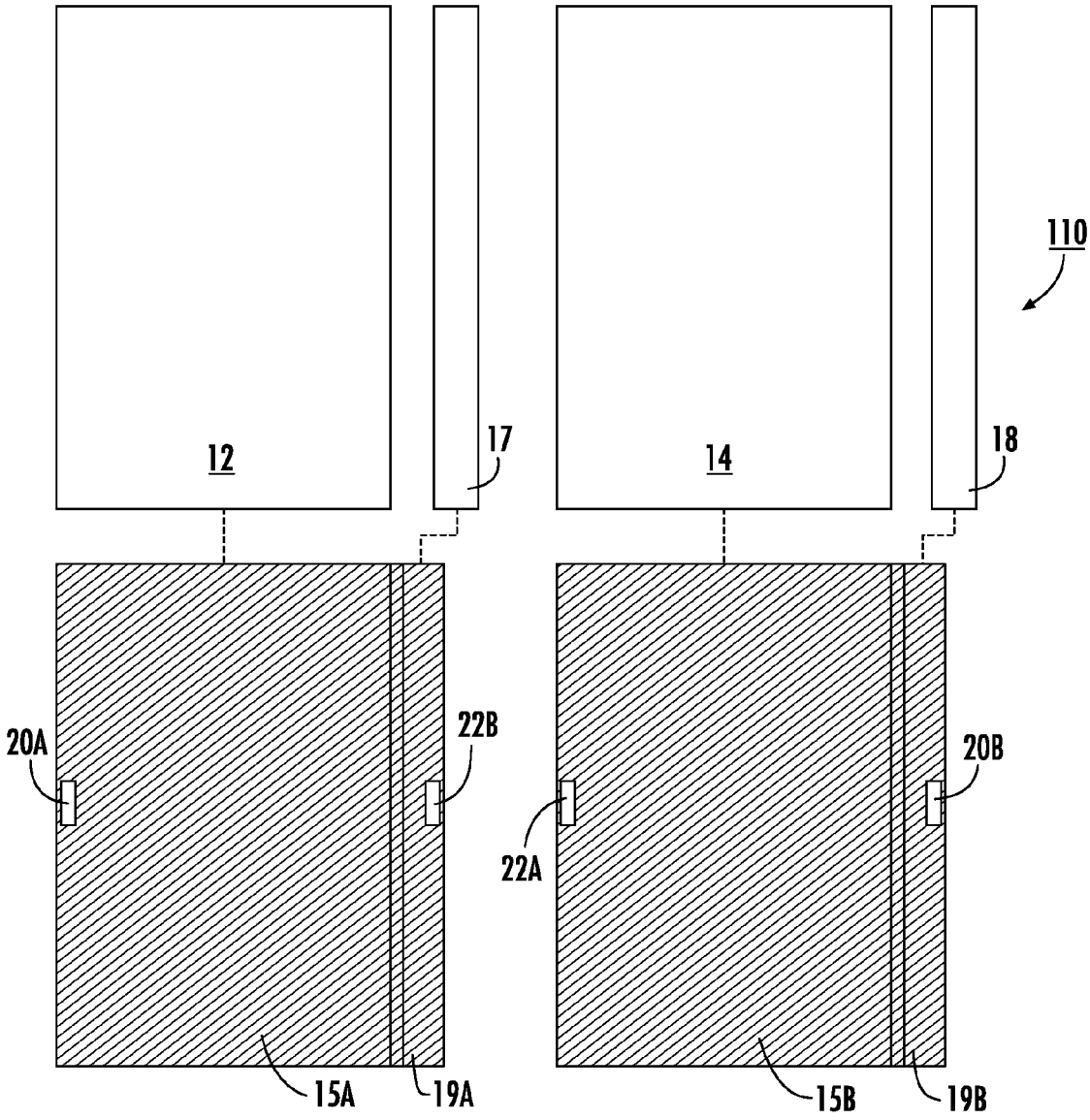
FIG. 3 is an exploded front elevational schematic of another embodiment of a reversible book in accordance with the invention with the cover strips removed for clarity.

A preferred embodiment of the inventive book appears in FIGS. 3-6. Like elements are represented by like reference numerals, and their respective descriptions will not be repeated. As best shown in FIG. 3, in addition to cover boards 12 and 14, reversible book 110 includes at least one and preferably two floating spines 17 and 18. Binding section 15A wraps around cover board 12 and floating spine 17, and binding section 15B wraps around cover board 15B and floating spine 18. Since each binding section 15 (A or B) is preferably made from a single sheet of material, the fabric of a section 15 wraps around its floating spine to create a pocket 19 for the floating spine. Thus, binding section 15A secures floating spine 17 within pocket 19A, and binding section 15B secures floating spine 18 within pocket 19B. The hinges 30 (see FIGS. 4 and 5) formed between each cover board and its respective floating spine are much more like a conventional bound book hinge, which allows for between 90 and 180 degrees of relative movement, owing to the stiffness of the binding fabric.

Figure 5:
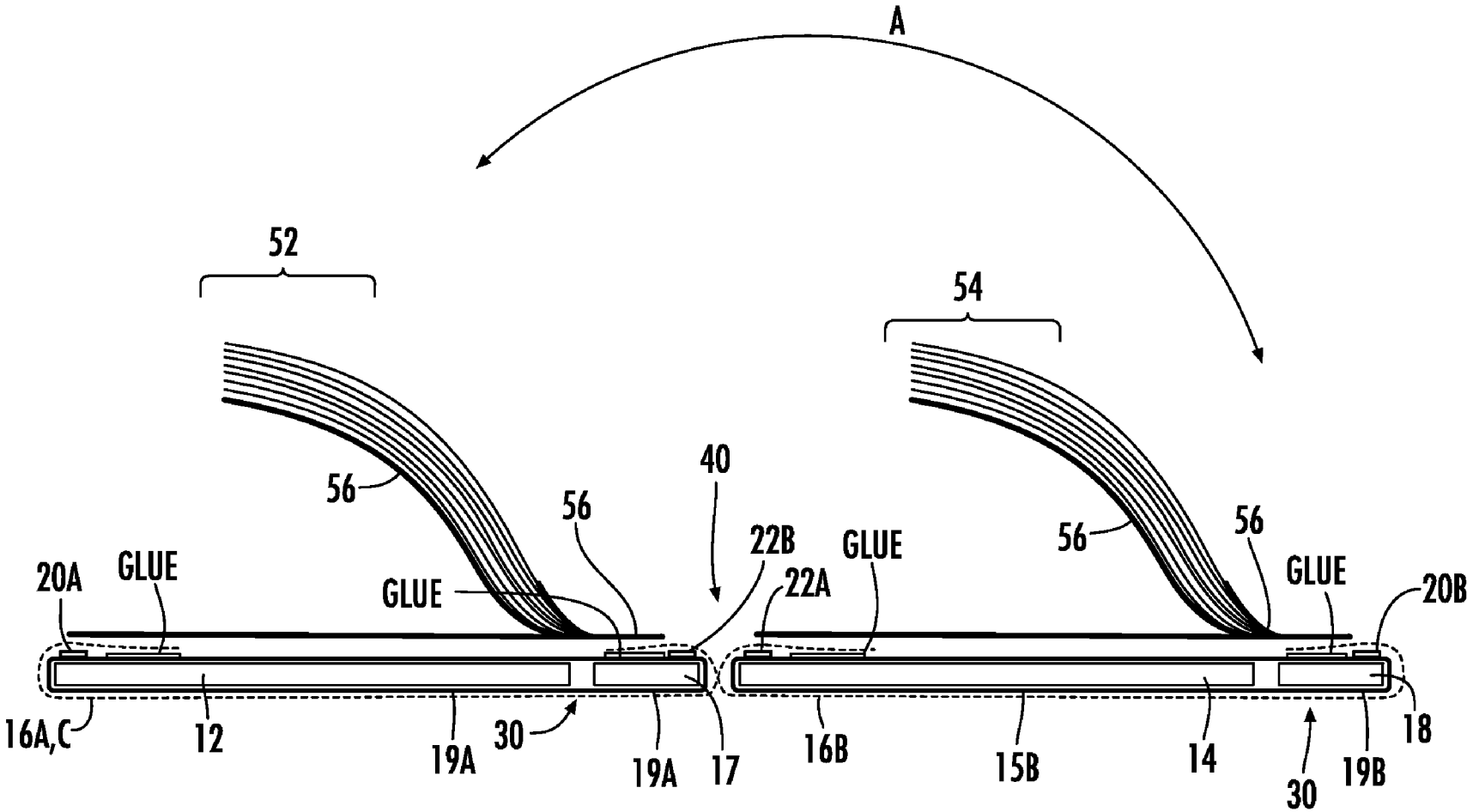
FIG. 5 is a bottom elevational schematic of the reversible book of FIGS. 3 and 4 including pages.

Once the cover boards 12 and 14 and their respective spines 17 and 18 are bound together, reversible cover strips 16A-C are applied as before. FIG. 4 illustrates the final assembly of cover strips 16A-C on reversible book 110 without pages, and FIG. 5 is a bottom view schematic illustrating the finished book 110 (the cover strips are shown in dotted lines for clarity). As with the simpler embodiment of FIG. 1, since the cover boards 12 and 14 are only attached together via reversible cover strips 16, a double hinge 40 is created therebetween, which enables cover board 12 to be rotated 720 degrees with respect to cover board 14 and which enables the reversal of cover strips 16. As explained above, the end of a strip 16 that has passed over a cover board extends across the cover board and folds around the outer edge and is glued to the underside of the cover board. The end that weaves under the cover board is glued directly onto the underside of the board without extending across. This creates hinge 40. As shown in FIG. 5, the cover strips cross each other at hinge 40, with strips 16A and C going one way and 16B going the other way.

In the preferred embodiment, two sets of pages 52 and 54 are bound to the book, as best shown in FIG. 5. Set 52 is bound to cover board 12 and floating spine 17, and set 54 is bound to cover board 54 and floating spine 18. Since flipping the book from one configuration to the other changes which set of pages is presented as the "front" set, there is a clear delineation of which set of pages corresponds to which cover. Pages 52 and 54 are preferably bound to their respective cover boards via conventional means, and may include end paper 56, for example. End paper 56 preferably (but not necessarily) sits atop the various glued down ends of cover strips 16A-C for aesthetic reasons.

When book 110 is in a first configuration, floating spine 17 (for example) serves as the spine of the book, while floating spine 18 sticks up or out from the distal end of cover board 14. In a preferred embodiment, the floating spine that is not currently being used as the spine of the book (that is, the "free" floating spine in a given book configuration) may be used as part of a closure mechanism securing the book closed to some extent. As shown in FIGS. 3 and 4, book 110 may be provided with closure mechanisms 20 and 22 to effect book closure and securement. Closure 20 includes a first closure half 20A disposed on one end of cover board 12 and a mating second closure half 20B disposed on one end of floating spine 18. Similarly, closure 22 includes a first closure half 22A disposed on one end of cover board 14 and a mating second closure half 22B disposed on one end of floating spine 17. When book 110 is closed as shown by arrow A in FIG. 5, closure half 20A contacts and is secured to closure half 20B, and the book is shut tightly. A similar result occurs when the book is in its second configuration and closure half 22A contacts and is secured to closure half 22B. The closure mechanisms 20, 22 may be snaps, hook and loop fasteners such as Velcro®, magnets, or the like, and they may employ a locking mechanism (not shown) in the style of a diary or journal. Closure mechanisms 20 and 22 may be of the same type (e.g., both pairs of magnets) or of different types.

Manipulation and operation of the inventive book is shown sequentially in FIGS. 6-1 through 6-20. In FIG. 6-1, the reader is viewing the front cover of book 110', which is in its first configuration. Book 110' has central cover strip 16B on its front side and top and bottom cover strips 16A and C on the rear side, the opposite of what is shown in FIGS. 4, 7, and 8, but the principles are the same. In any event, here, cover strips 16A-C have side 16-1 facing the reader as part of front and back cover #1. The book is opened in FIG. 6-2 as a regular book would be opened, presenting first set of pages 52. The first set of pages 52 are read and turned in FIG. 6-3. When the reader has finished with the first set of pages 52, and the book is open to the center of the book as shown in FIG. 6-4, the center spread reveals floating spine 17 and a second set of pages 54. Pages 54 are attached to cover board 14 as described above on the opposite side as pages 52. In FIG. 6-4, the last of pages 54 is visible.

At this point, the book is begun to be folded backwards upon itself as shown in FIG. 6-5 at hinge 40 until the front and back covers meet 360 degrees from whence they started (see FIG. 6-6) as the book is turned inside-out. As shown in FIG. 6-7, the reader's left thumb holds floating spine 17 as the reader's right thumb holds the opposing cover board 14 (other fingers can be used, of course). The double hinge action created by cover strips 16A-C allows the book to open the opposite way, as shown in FIG. 6-8 revealing back cover #2 (strip sides 16A-2 and 16C-2 and central section of board side 12A) and front cover #2 (upper and lower sections of board side 14B and strip side 16B-2). The book folds back on itself as shown in FIG. 6-9, and floating spine 18 is revealed in FIG. 6-10. The book is now completely reversed as shown in FIG. 6-11, and cover #2 (sides 16-2 of cover strips 16) serves as the front and back cover of the book.

The book is now opened in FIG. 6-12 to reveal the second set of pages 54, which are read and turned as conventional pages in FIG. 6-13. When the reader has finished with the second set of pages 54, and the book is open to the center of the book as shown in FIG. 6-14, the center spread reveals floating spine 18 (and the last page of first set of pages 52).

The book is begun to be folded backwards upon itself as shown in FIG. 6-15 at hinge 40 until the front and back covers meet (see FIG. 6-16) as the book is turned inside-out. As shown in FIG. 6-17, the reader's left thumb holds floating spine 18 as the reader's right thumb holds the opposing cover board 12 (other fingers can be used, of course). The double hinge action created by cover strips 16A-C allows the book to open the opposite way, as shown in FIG. 6-18 revealing back cover #1 and front cover #1, i.e., sides 16-1 of the cover strips 16. The book folds back on itself as shown in FIG. 6-19, and the book is back to its first configuration in FIG. 6-20.

The invention is not limited to the above description. For example, while three cover strips are shown and described in the preferred embodiment, the invention may utilize as few as two cover strips or as many as physically practical. Also, the two sets of pages are largely described above as being different language versions of the same text, however the two sets of pages could have a different relationship. For example, one set of pages could be the sequel to the other. Also, the two sections of the book could represent yellow pages and white pages of a telephone directory. Other contemplated relationships include travel journals, diaries, notebooks, etc. Moreover, the term "pages" as used throughout the specification and claims in connection with the invention (e.g., "first set of pages", "second set of pages") is not limited to typical hardbound or paperback book pages. Rather, it is contemplated that the term "pages" incorporate anything that can be bound in book form, including but not limited to sleeves (for photographs, cards, ticket stubs, etc.), folders, stickers, templates, stencils, etc. Also, the two sections could have no relationship at all apart from being bound together in the same physical book. That is, the invention is not text- or content-specific. Additionally, the various embodiments of the invention have shown the "first" cover board to be on the left side when the book is in its first configuration and open and the "second" cover board on the right side. The invention is not so limited, and it does not matter which cover board is the "first" one and which is the "second" one.

Having described certain embodiments of the invention, it should be understood that the invention is not limited to the above description or the attached exemplary drawings. Rather, the scope of the invention is defined by the claims appearing hereinbelow and any equivalents thereof as would be appreciated by one of ordinary skill in the art.

What is claimed is:

1. A reversibly bound book, configurable between a first configuration and a second configuration, comprising:

first and second cover boards each having a first side and a second side and a first edge and a second edge;

a first cover strip having a first end wrapped around said first edge of said first cover board and secured to said second side of said first cover board; and a second end secured to said first side of said second cover board, said first cover strip passing over said first side of said first cover board and along said first side of said second cover board; and a second cover strip having a first end wrapped around said second edge of said second cover board and secured to said first side of said second cover board; and a second end secured to said second side of said first cover board, said second cover strip passing along said second side of said second cover board and over said second side of said first cover board.

2. A reversibly bound book according to claim 1, further comprising a third cover strip substantially identical to one of said first cover strip or said second cover strip.

3. A reversibly bound book according to claim 1, wherein said first and second cover boards are not attached to each other except via said cover strips.

4. A reversibly bound book according to claim 1, further comprising:

a first set of pages attached to said first cover board; and a second set of pages attached to said second cover board.

5. A reversibly bound book according to claim 1, said first and second cover strips each having first and second surfaces, further comprising a first design formed on said first surfaces and a second design formed on said second surfaces.

6. A reversibly bound book according to claim 1, further comprising at least one floating spine fixedly hingedly bound to one of said edges of one of said first or second cover boards.

7. A reversibly bound book according to claim 1, further comprising:

a first floating spine fixedly hingedly bound to said first cover board; and a second floating spine fixedly hingedly bound to said second cover board.

8. A reversibly bound book according to claim 6, further comprising fastening means for closing said book having a first half and a mating second half, said first half being disposed on said floating spine and said second half being disposed on the mating of said edges of said opposite of said first or second cover board.

9. A reversibly bound book according to claim 7, further comprising:

a first fastening means for closing said book having a first half and a mating second half, said first half being disposed on said first floating spine and said second half being disposed on a mating edge of said second cover board; and a second fastening means for closing said book having a first half and a mating second half, said first half being disposed on said second floating spine and said second half being disposed on a mating edge of said first cover board.

10. A reversibly bound book according to claim 9, wherein said first halves of said first and second fastening means are respectively disposed on a non-bound edge of each of said first and second floating spines.

11. A reversibly bound book according to claim 1, wherein when said book is in said first configuration, said first cover board is part of a first front cover of said book and said second cover board is part of a first back cover of said book, and when said book is in said second configuration, said second cover board is part of a second front cover of said book and said first cover board is part of a second back cover of said book.

12. A reversibly bound book according to claim 11, wherein when said book is in its first configuration, said first sides of said first and second cover strips form at least parts of said first front and back covers, and when said book is in said second configuration, said second sides of said first and second cover strips form at least parts of said second front and back covers.

* * * * *